US007517038B2

(12) United States Patent
Otsuki

(10) Patent No.: US 7,517,038 B2
(45) Date of Patent: Apr. 14, 2009

(54) ADJUSTMENT OF MISALIGNMENTS OF RECORDING POSITIONS DURING BI-DIRECTIONAL PRINTING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/674,808

(22) Filed: Oct. 1, 2003

(65) Prior Publication Data

US 2004/0207674 A1 Oct. 21, 2004

(30) Foreign Application Priority Data

Oct. 3, 2002 (JP) ..... 2002-291559

(51) Int. Cl.
*B41J 29/393* (2006.01)
*B41J 2/21* (2006.01)
*B41J 2/205* (2006.01)

(52) U.S. Cl. ..... 347/14; 347/15; 347/19; 347/43

(58) Field of Classification Search ..... 347/43, 347/86, 6, 7, 14, 19
See application file for complete search history.

(56) References Cited

U.S. PATENT DOCUMENTS

| | | | | |
|---|---|---|---|---|
| 5,481,288 | A * | 1/1996 | Keeling et al. | 347/80 |
| 5,539,434 | A * | 7/1996 | Fuse | 347/19 |
| 5,805,184 | A * | 9/1998 | Horiike | 347/43 |
| 6,145,950 | A * | 11/2000 | Ohtsuka et al. | 347/15 |
| 6,158,834 | A * | 12/2000 | Kato et al. | 347/43 |
| 6,244,681 | B1 * | 6/2001 | Yano et al. | 347/15 |
| 6,267,519 | B1 * | 7/2001 | Otsuki et al. | 400/283 |
| 6,268,927 | B1 * | 7/2001 | Lo et al. | 358/1.15 |
| 6,293,647 | B2 * | 9/2001 | Saijo | 347/24 |
| 6,299,285 | B1 * | 10/2001 | Inui | 347/43 |
| 6,305,781 | B1 * | 10/2001 | Hull | 347/40 |
| 6,315,381 | B1 * | 11/2001 | Wade et al. | 347/19 |
| 6,318,827 | B1 * | 11/2001 | Brenner et al. | 347/9 |
| 6,454,381 | B1 * | 9/2002 | Olsen et al. | 347/19 |
| 6,491,373 | B1 * | 12/2002 | Fujita et al. | 347/41 |
| 6,523,926 | B1 * | 2/2003 | Mitsuzawa et al. | 347/19 |
| 6,532,026 | B2 * | 3/2003 | Takahashi et al. | 347/41 |
| 6,547,360 | B2 * | 4/2003 | Takahashi et al. | 347/19 |
| 6,588,872 | B2 * | 7/2003 | Anderson et al. | 347/19 |
| 6,655,779 | B2 * | 12/2003 | Usui et al. | 347/19 |
| 6,692,096 | B1 * | 2/2004 | Otsuki et al. | 347/14 |
| 6,700,593 | B2 * | 3/2004 | Otsuki | 346/19 |
| 6,746,101 | B2 * | 6/2004 | Otsuki | 347/37 |
| 6,827,418 | B2 * | 12/2004 | Otokita | 347/19 |
| 6,883,892 | B2 * | 4/2005 | Sievert et al. | 347/19 |
| 6,962,404 | B2 * | 11/2005 | Nunokawa et al. | 347/43 |
| 2004/0095408 | A1 * | 5/2004 | Nunokawa et al. | 347/19 |
| 2005/0231543 | A1 * | 10/2005 | Hosono | 347/15 |

FOREIGN PATENT DOCUMENTS

| | | | |
|---|---|---|---|
| JP | 10-6533 | A | 1/1998 |
| JP | 11-286142 | A | 10/1999 |
| JP | 2002-192810 | A | 7/2002 |

* cited by examiner

*Primary Examiner*—Luu Matthew
*Assistant Examiner*—Shelby Fidler
(74) *Attorney, Agent, or Firm*—Sughrue Mion, PLLC

(57) ABSTRACT

Misalignments of dot forming positions are adjusted by selectively using a position adjustment value for a used bi-directional print mode out of a plurality of position adjustment values that are respectively suitable for a plurality of bi-directional print modes including a first bi-directional print mode and a second bi-directional print mode that are made available by changing ink types.

23 Claims, 17 Drawing Sheets

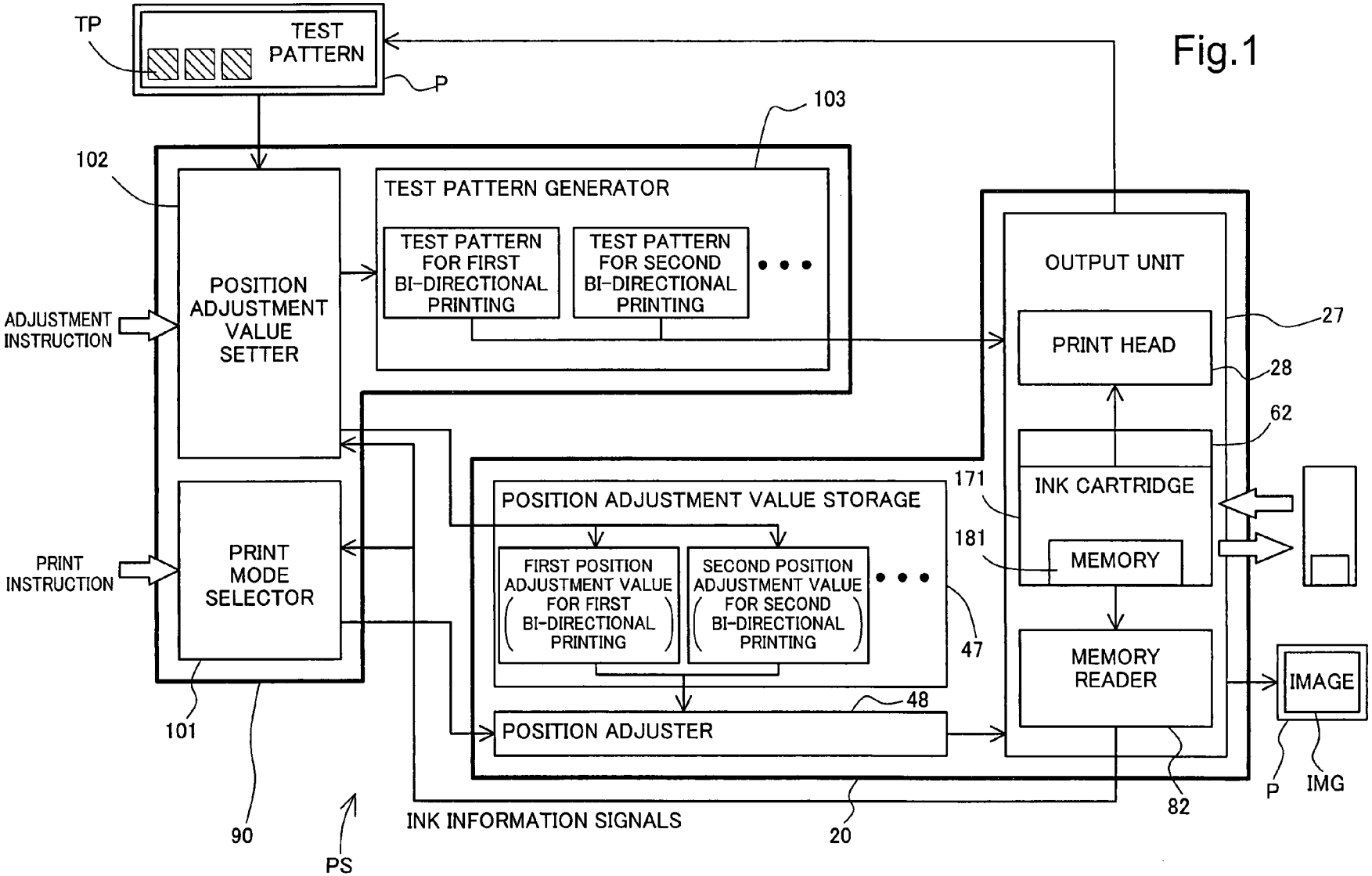
Fig.1
OUTPUT UNIT
PRINT HEAD
INK CARTRIDGE
MEMORY
MEMORY READER
IMAGE
IMG
P
27
28
62
82
171
181
47
48
20
POSITION ADJUSTMENT VALUE STORAGE
FIRST POSITION ADJUSTMENT VALUE FOR FIRST BI-DIRECTIONAL PRINTING
SECOND POSITION ADJUSTMENT VALUE FOR SECOND BI-DIRECTIONAL PRINTING
POSITION ADJUSTER
INK INFORMATION SIGNALS
103
TEST PATTERN GENERATOR
TEST PATTERN FOR FIRST BI-DIRECTIONAL PRINTING
TEST PATTERN FOR SECOND BI-DIRECTIONAL PRINTING
TEST PATTERN
P
TP
102
POSITION ADJUSTMENT VALUE SETTER
PRINT MODE SELECTOR
101
90
PS
ADJUSTMENT INSTRUCTION
PRINT INSTRUCTION

Fig.12

| NOZZLE GROUP NUMBER | N11 | N12 | N13 | N14 | N15 | N16 | N17 | N18 |
|---|---|---|---|---|---|---|---|---|
| LABEL NUMBER | 1 | 2 | 3 | 4 | | 5 | 6 | 7 |
| I S 1 1 | Y | M | C | K | | C | M | Y |
| I S 1 2 | DY | LM | LC | K | | C | M | Y |

INKS SUBJECT TO REPLACEMENT

Fig.13(a)

| I S 1 1 | N11 | N12 | N13 | N14 | N15 | N16 | N17 | N18 |
|---|---|---|---|---|---|---|---|---|
| | Y | M | C | K | K | C | M | Y |
| MONOCHROME | | | | K | K | | | |
| FOUR-COLOR | Y | M | C | K | K | C | M | Y |

Fig.13(b)

| I S 1 2 | N11 | N12 | N13 | N14 | N15 | N16 | N17 | N18 |
|---|---|---|---|---|---|---|---|---|
| | DY | LM | LC | K | K | C | M | Y |
| MONOCHROME | | | | K | K | | | |
| SEVEN-COLOR | DY | LM | LC | K | K | C | M | Y |

INKS USED TO PRINT A TEST PATTERN

| NOZZLE ARRAY NUMBER | N21 | N22 | N23 | N24 | N25 | N26 | N27 | N28 |
|---|---|---|---|---|---|---|---|---|
| LABEL NUMBER | 1 | 2 | 3 | 4 | 5 | 6 | 7 | 8 |
| IS21 | Y | M | C | K | K | C | M | Y |
| IS22 | DY | LM | LC | K | LK | C | M | Y |

INKS SUBJECT TO REPLACEMENT

Fig.19(a) IS21

| INK TYPE | Y | M | C | K | K | C | M | Y |
|---|---|---|---|---|---|---|---|---|
| NOZZLE ARRAY NUMBER | N21 | N22 | N23 | N24 | N25 | N26 | N27 | N28 |
| MONOCHROME | | | | (K) | (K) | | | |
| FOUR-COLOR | (Y) | (M) | (C) | K | K | (C) | (M) | (Y) |

Fig.19(b) IS22

| INK TYPE | DY | LM | LC | K | LK | C | M | Y |
|---|---|---|---|---|---|---|---|---|
| NOZZLE ARRAY NUMBER | N21 | N22 | N23 | N24 | N25 | N26 | N27 | N28 |
| MONOCHROME | | | | (K) | | | | |
| HIGH-QUALITY MONOCHROME | | | | K | (LK) | | | |
| EIGHT-COLOR | DY | (LM) | (LC) | K | (LK) | C | M | (Y) |

(○) INKS USED TO PRINT A TEST PATTERN

ADJUSTMENT OF MISALIGNMENTS OF RECORDING POSITIONS DURING BI-DIRECTIONAL PRINTING

BACKGROUND OF THE INVENTION

1. Field of the Invention

The present invention relates to a technique for printing images by forming dots on a printing medium during main scanning, and more particularly to a technique for adjusting misalignments of recording positions in the main scanning direction to improve quality of printed images.

2. Description of the Related Art

Recently, printing apparatuses that print images by ejecting ink droplets to form ink dots on a printing medium are widely used as output devices of images. Hereinafter, such printing apparatus will be referred to as ink jet printing apparatus. A print head of the ink jet printing apparatus is provided with a plurality of nozzle groups for respective color inks, and the ink jet printing apparatus prints images by ejecting ink from each nozzle onto the printing medium to form ink dots on the printing medium. These printing apparatuses often perform bi-directional printing in which ink dots are formed on not only forward passes but also backward passes of main scanning while the print head is reciprocating relative to the printing medium, to achieve higher printing speed. In the case of bi-directional printing, an adjustment process for reducing misalignments of dot forming positions is performed by setting a position adjustment value for adjusting misalignments of ink dot forming positions on forward passes and backward passes in order to improve picture quality (e.g. JAPANESE PATENT LAID-OPEN GAZETTE No. 11-286142).

Some recent printing apparatuses can change the type of ink ejected by each nozzle group to perform a variety of bi-directional printings having different characteristics of print performance such as quality-conscious bi-directional printing and speed-conscious bi-directional printing according to the situation of the printing. However, changing ink types may vary the ink type whose misalignments of dot forming positions tend to be conspicuous. Therefore, even if the forming positions of ink dots are adjusted based on the identical position adjustment value, dots formed by a nozzle group, whose misalignments were inconspicuous before the change of inks, may become conspicuous due to the change of inks, which prevents improved picture quality.

SUMMARY OF THE INVENTION

An object of the present invention is to improve picture quality when performing bi-directional printing in which ink types ejected by the nozzle groups of the print head have been changed.

In order to solve at least part of the above-mentioned problems, a printing apparatus according to the present invention includes a print head that has a plurality of nozzle groups each including a plurality of nozzles for ejecting an identical color, and the apparatus has a bi-directional printing function of performing main scanning for moving the print head relative to a printing medium and sub scanning for moving the print head relative to the printing medium in a direction that transverses the direction of the main scanning while ejecting ink from the nozzles onto the printing medium on each of forward passes and backward passes of the main scanning of bi-directional movement to form dots on the printing medium. This printing apparatus includes a position adjustment value storage that stores a position adjustment value for reducing misalignments of dot forming positions between forward passes and backward passes of the main scanning; a position adjuster that adjusts dot forming positions along the main scanning direction during the bi-directional printing based on the position adjustment value stored in the position adjustment storage; and an ink cartridge mount that can mount one or more ink cartridges thereon, the one or more ink cartridges having ink tanks each containing ink to be supplied to each of the nozzle groups, wherein the printing apparatus can use a first ink set and a second ink set that have mutually different combinations of available inks through replacement of at least one of the ink tanks with another ink tank containing different ink. The printing apparatus can use a first bi-directional print mode that selectively uses inks included in the first set of inks and a second bi-directional print mode that selectively used inks included in the second set of inks so that the combination of inks used in the first bi-directional print mode is different from the combination of inks used in the second bi-directional print mode. The position adjustment value storage can store a plurality of position adjustment values including a first position adjustment value for the first bi-directional print mode and a second position adjustment value for the second bidirectional print mode, and the position adjustment unit selects the position adjustment value for the bi-directional print mode used out of the plurality of position adjustment values to adjust dot forming positions.

According to this printing apparatus, an appropriate position adjustment value is used in each of the first and second bi-directional print modes that become available through changing ink types, thereby attaining bi-directional printing with improved picture quality even if ink types have been changed.

The present invention may take a variety of forms, for example, a printing method and printing device; a print control method and print controller; a computer program for realizing the functions of these methods and devices; a storage medium storing the computer program; a data signal embodied in a carrier wave containing the computer program; and so on.

These and other objectives, features, aspects, and advantages of the present invention will become more apparent from the following description of the preferred embodiments with the accompanying drawings.

BRIEF DESCRIPTION OF THE DRAWINGS

FIG. 1 is a schematic diagram that shows an overview of a printing system;

FIG. 12 is a schematic diagram that shows relationships among sets of inks, ink types, and used nozzle groups;

FIGS. 13(*a*) and 13(*b*) are schematic diagrams that show relationships between the sets of inks and bi-directional print modes;

FIGS. 19(*a*) and 19(*b*) are schematic diagrams that show relationships between sets of inks and bi-directional print modes.

DESCRIPTION OF THE PREFERRED EMBODIMENTS

Figure 2:
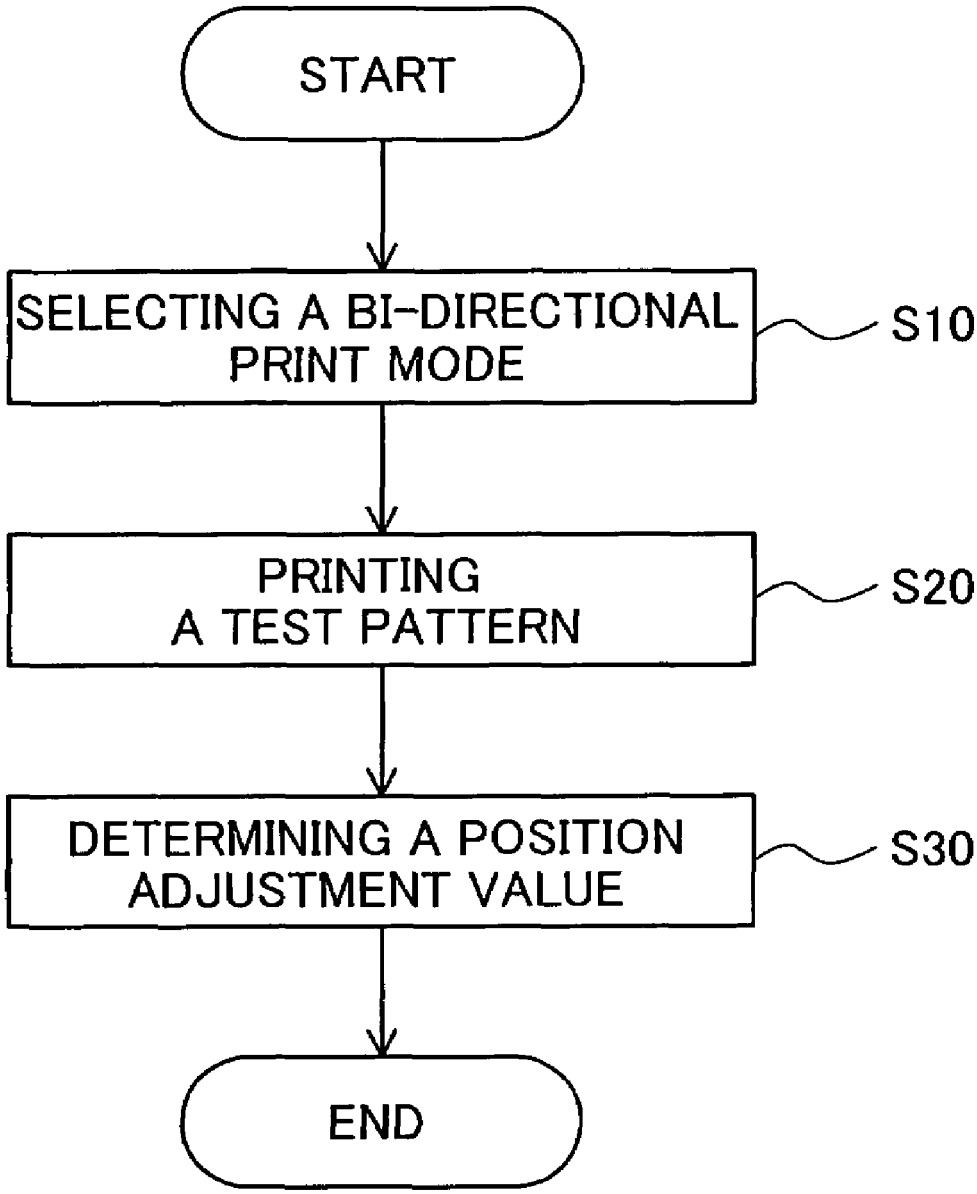
FIG. 2 is a flowchart that shows a procedure for setting a position adjustment value.

Modes of the present invention are described through embodiments in the following sequence.

A. Exemplary Printing System
B. Structure of Apparatus
C. Outline of Adjustment Process of Dot Forming Positions
D. Embodiment of Adjustment Process of Dot Forming Positions
E. Modifications

A. Exemplary Printing System

FIG. 1 is a schematic diagram that shows an overview of a printing system as one embodiment of the present invention. This printing system PS includes a computer 90 as a print controller and a printer 20 as a printing unit. The computer 90 and the printer 20 are connected with each other via connectors (not shown), and can transmit data to and from each other. In the broad sense, such combination of the printer 20 and the computer 90 can be referred to as "printing apparatus."

The printer 20 includes a position adjustment value storage 47, a position adjuster 48, and an output unit 27. The output unit 27 includes a print head 28, an ink cartridge mount 62, and a memory reader 82. The ink cartridge mount 62 has one or more ink cartridges 171 mounted thereon, which contain a plurality of different types of ink to be supplied to the print head 28. The output unit 27 performs printing by ejecting ink from nozzles of the print head 28 onto a printing medium P (not shown) during main scanning for moving the print head 28 relative to the printing medium P. It can also perform bi-directional printing in which ink is ejected on each of forward and backward passes of the bi-directional main scanning. During the bi-directional printing, misalignments of forming positions of ink dots recorded on forward passes and on backward passes are adjusted by the position adjuster 48. Details of the bi-directional printing will be described later. The ink cartridge 171 can be replaced with another ink cartridge containing another type of ink, thereby enabling to use another type of bi-directional print mode with another combination of used inks. The ink cartridge 171 includes a memory 181 for storing information on the type of ink contained therein, and the memory reader 82 reads out the ink information. The read ink information can be used to identify the types of inks mounted (Details will be described later.).

The position adjuster 48, which has a function of adjusting ink dot forming positions during bi-directional printing, adjusts the forming positions according to a position adjustment value stored in the position adjustment value storage 47 (Details will be described later.).

The position adjustment value storage 47 can store a plurality of position adjustment values that are respectively suitable for a plurality of bi-directional print modes including a first bi-directional print mode and a second bi-directional print mode. The first and second bi-directional print modes are made available by changing ink types, and have mutually different combinations of ink types used. During bi-directional printing, the position adjuster 48 selectively uses the position adjustment value for the used bi-directional print mode out of the position adjustment values stored in the position adjustment value storage 47 to adjust ink dot forming positions. For example, when the first bi-directional print mode is used, the position adjuster 48 uses a first position adjustment value for the first bi-directional print mode. When the ink cartridge 171 is replaced to use the second bi-directional print mode with another combination of ink types used, a second position adjustment value for the second bi-directional print mode is used. In this manner, even if the ink cartridge is replaced to use another print mode with another combination of ink types used, the position adjustment value for the used print mode can be used, thereby attaining high-quality bi-directional printing.

The computer 90 includes a position adjustment value setter 102, a print mode selector 101, and a test pattern generator 103. The position adjustment value setter 102 performs a process of setting the position adjustment value for each of the available bi-directional print modes. The user instructs the position adjustment setter 102 to set the position adjustment value for each bi-directional print mode, which is stored in the position adjustment value storage 47. FIG. 2 is a flowchart that shows a procedure for setting a position adjustment value. At step S10, the user uses the position adjustment value setter 102 to select a bi-directional print mode being subject to setting of the position adjustment value. Next, at step S20, the test pattern generator 103 generates a test pattern TP for the bi-directional print mode selected at step S10. The test pattern TP can be used to test misalignments of dot forming positions caused during the bi-directional printing. The generated test pattern TP is converted into print data, sent to the printer 20, and then printed by the output unit 27. Next, at step S30, the user uses the printed test pattern to determine a preferred position adjustment value that attains high-quality prints, and then sets the determined result via the position adjustment value setter 102. The determined result set by the position adjustment value setter 102 is stored in the position adjustment value storage 47 as the position adjustment value for the bi-directional print mode, which is to be used by the position adjuster 48 during the bi-directional printing, and then the process is completed. The test pattern TP may include a set of ruled lines, a plurality of color patches that reproduce an identical color, and the like, which are selectively used according to the bi-directional print mode. The user can select the highest-quality one out of the rules or patches included in the printed result of such test pattern to determine the preferred position adjustment value. The test pattern and the position adjustment value will be described later.

The position adjustment value setter 102 (FIG. 1) can use information on inks that are required by each of the available bi-directional print modes, and information on available inks based on ink information signals from the memory reader 82 of the printer 20. The position adjustment value setter 102 can compare these two information on inks and thereby select the available bi-directional print modes to allow the user to select the bi-directional print mode being subject to setting of the position adjustment value out of the available bi-directional print modes. This ensures proper selection of the bi-directional print modes that can be performed with the mounted ink cartridges even if the ink cartridge has been replaced. The ink information signals will be described later.

The test pattern generator 103 can generate a plurality of test patterns that are respectively suitable for the plurality of bi-directional print modes including the first and second bi-directional print modes. In this manner, the test pattern can be printed according to each of the bi-directional print modes, and therefore the position adjustment value can be set so as to be suitable for each of the bi-directional print modes. The test patterns and the settings of position adjustment values will be described in detail later.

The print mode selector 101 performs a process of selecting the bidirectional print mode used for printing out of the plurality of available bi-directional print modes. The user can instruct the print mode selector 101 to select the used bi-directional print mode. The position adjustment unit 48 uses the position adjustment value for the bi-directional print mode selected by the print mode selector 101 to adjust ink dot forming positions. Therefore, the high-quality printing can be performed that uses the bi-directional print mode selected by the user.

The print mode selector 101 can also use the information on inks that are required by each of the available bi-directional print modes, and the information on available inks based on the ink information signals from the printer 20 in the same manner as the position adjustment value setter 102. The print mode selector 101 can compare these two information on inks and thereby select the available bi-directional print modes to allow the user to select the used bi-directional print mode out of the available bi-directional print modes. This ensures proper selection of the bi-directional print mode that can be performed with the mounted ink cartridges even if the ink cartridge has been replaced.

B. Structure of Apparatus

Figure 3:
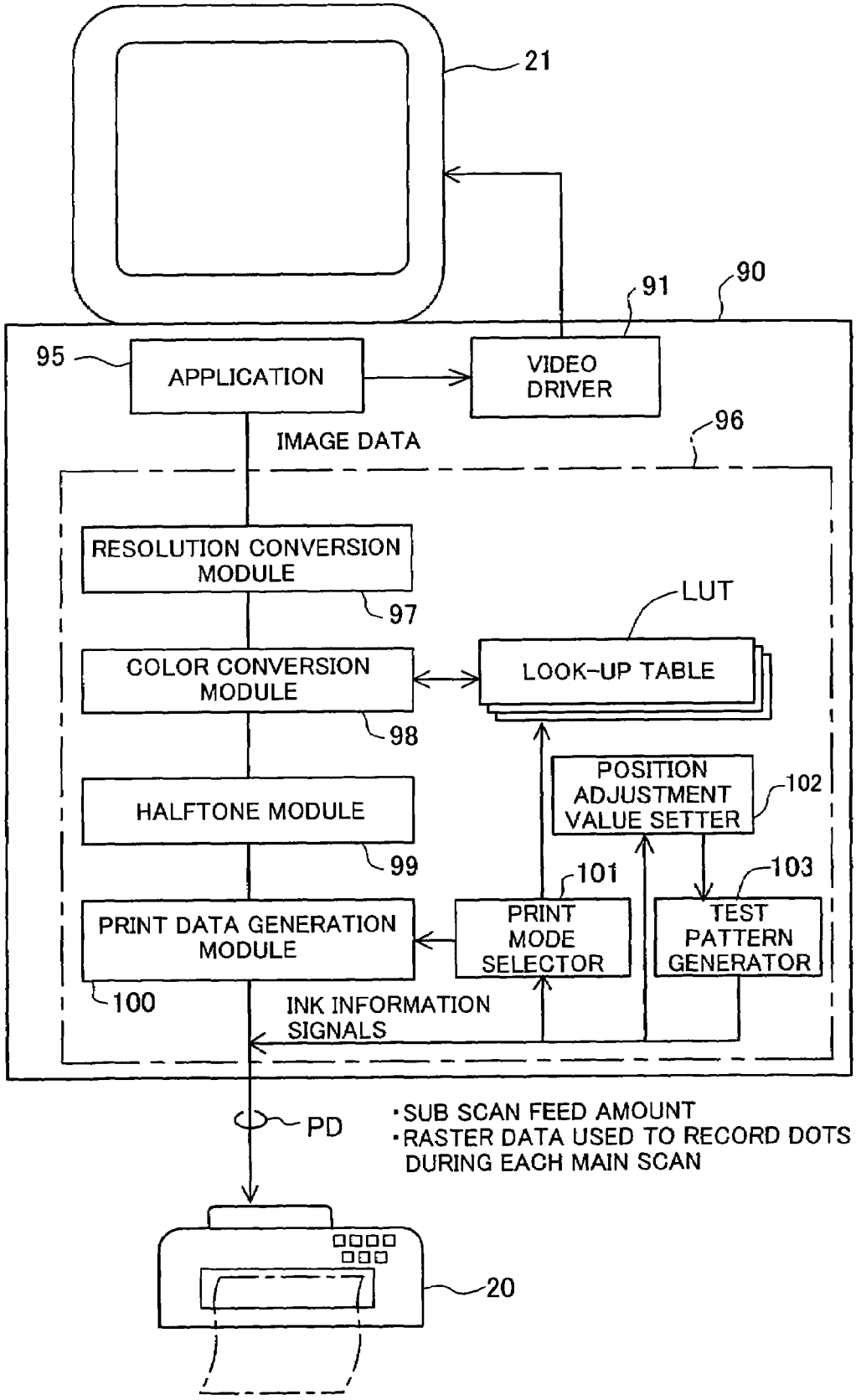
FIG. 3 is a schematic diagram that shows a structure of the printing system.

FIG. 3 is a schematic diagram that shows a structure of the printing system including a printer driver 96 of the computer 90. The computer 90 includes application program 95 running on a predetermined operating system. A video driver 91 and the printer driver 96 are incorporated in the operating system, and print data PD to be sent to the printer 20 are output from the application program 95 via these drivers. The application program 95 performs a desired process on an image of interest, and displays the image on a CRT 21 via the video driver 91.

When the application program 95 issues a printing instruction, the printer driver 96 of the computer 90 receives image data from the application program 95 and then converts the image data into the print data PD to be supplied to the printer 20. In the example shown in FIG. 3, the printer driver 96 includes a resolution conversion module 97, a color conversion module 98, a halftone module 99, a print data generation module 100, the print mode selection unit 101, a plurality of look-up tables LUT, the position adjustment value setter 102, and the test pattern generation unit 103. The plurality of look-up tables LUT are provided according to the plurality of bi-directional print modes that can be selected by the print mode selector 101.

The resolution conversion module 97 functions to convert a resolution (i.e. the number of pixels per unit length) of the color image data handled by the application program 95 into a resolution applicable to the printer driver 96. The resolution-converted image data still remain image information consisting of three colors R, G, and B. The color conversion module 98 selects and refers to a look-up table corresponding to the bi-directional print mode selected by the print mode selector 101 out of the plurality of look-up tables LUT while converts RGB image data (first image data) into multi-tone data of multi ink colors (second image data), which can be used by the printer 20, for each pixel.

The color-converted multi-tone data, for example, have tone values of 256 tones. The halftone module 99 performs a halftone process in which ink dots are formed in a distributed fashion so as to express the tone values through the printer 20. The halftone-processed image data are rearranged by the print data generation module 100 into a data order in which they are transferred to the printer 20, and are then output as final print data PD. The print data PD includes raster data indicating the recording states of dots during each main scan, and data indicating sub scan feed amounts.

The printer driver 96 corresponds to a program that implements a function of generating the print data PD. The program implementing the function of the printer driver 96 is stored in a computer readable recording medium. Such recording medium may include a variety of computer-readable media such as flexible disk, CD-ROM, magneto-optics disc, IC card, ROM cartridge, punched card, a print with barcodes or other codes printed thereon, internal storage device (memory such as RAM and ROM) and external storage device of the computer, and the like.

Figure 4:
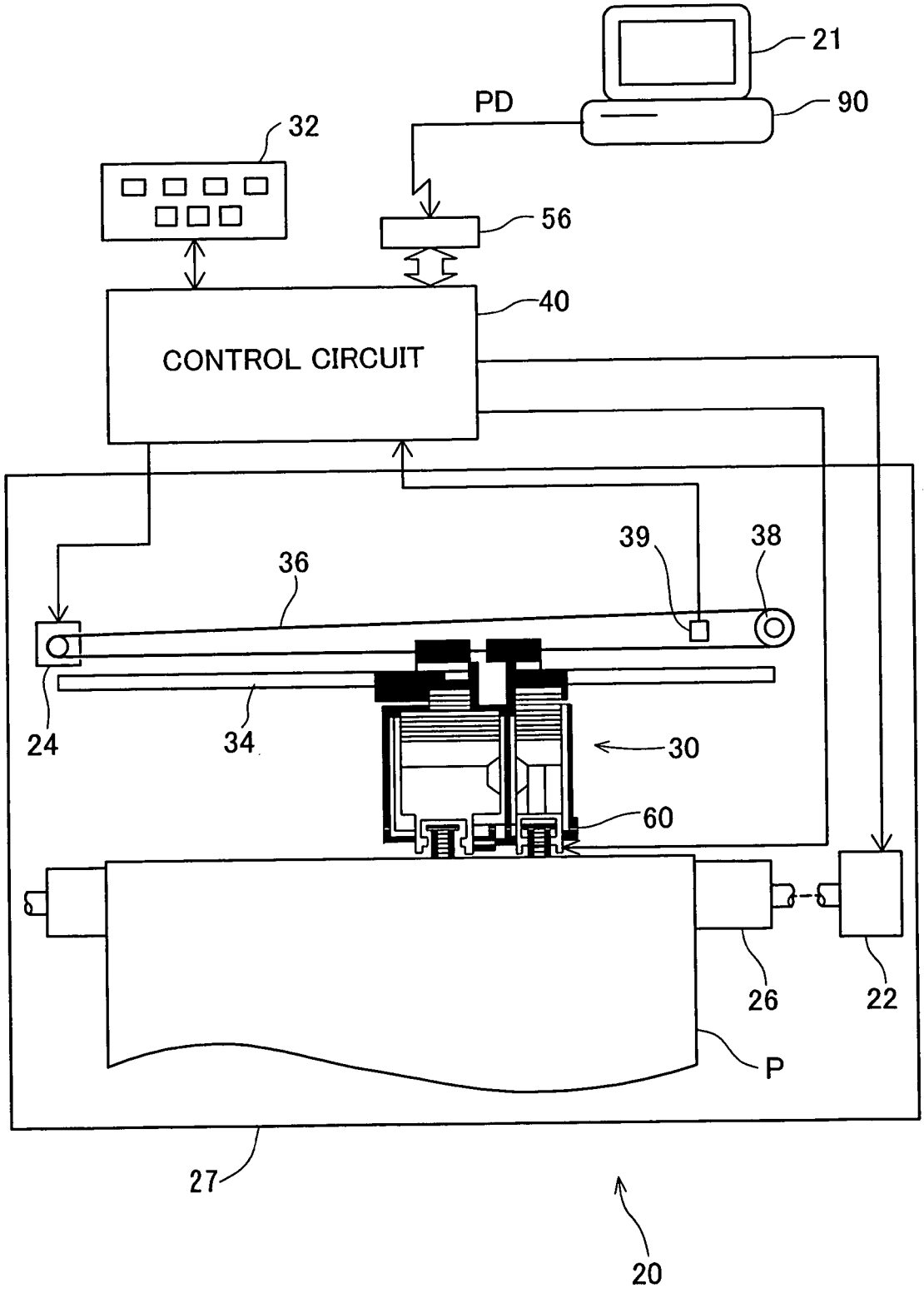
FIG. 4 is a schematic diagram that shows a general structure of a printer 20.

FIG. 4 is a schematic diagram that shows a general structure of the printer 20. The printer 20 includes the output unit 27 for printing, a control panel 32, and a control circuit 40 for controlling signal transmissions between the control panel 32 and the output unit 27. The output unit 27 includes a sub scanning mechanism for feeding the printing medium P in the sub scanning direction by means of a paper feed motor 22, a main scanning mechanism for reciprocating a carriage 30 in the axial direction (main scanning direction) of a platen 26 by means of a carriage motor 24, and a head drive mechanism for driving a print head unit 60 (also referred to as "print head assembly") mounted on the carriage 30 to control ejection of ink and formation of dots. The control circuit 40 is connected with the computer 90 via a connector 56. The printing medium P may include a variety of media, such as papers, film sheets, and vinyl sheets.

The sub scanning mechanism for feeding the printing medium P has a gear train (not shown) for transmitting rotations of the paper feed motor 22 to the platen 26 as well as a paper feed roller (not shown). The main scanning mechanism for reciprocating the carriage 30 includes a sliding shaft 34 arranged in parallel with the axis of the platen 26 for slidably supporting the carriage 30, a pulley 38, an endless drive belt 36 spanned between the carriage motor 24 and the pulley 38, and a position sensor 39 for detecting the original position of the carriage 30.

Figure 5:
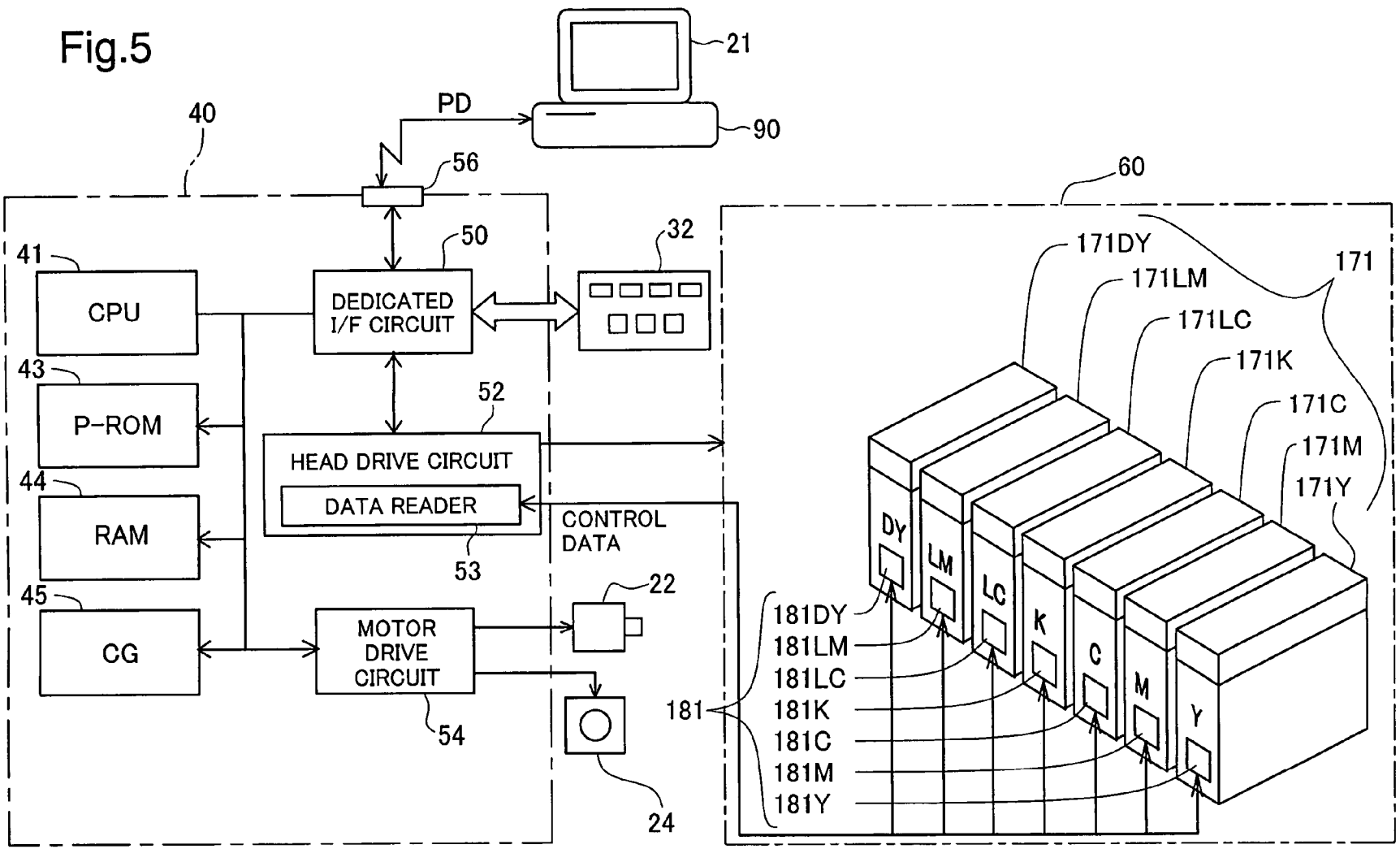
FIG. 5 is a block diagram that shows a structure of the printer 20.

FIG. 5 is a block diagram that shows the structure of the printing system 20 including the control circuit 40. The control circuit 40 is configured as an arithmetic and logic circuit that includes a CPU 41, a programmable ROM (PROM) 43, a RAM 44, and a character generator (CG) 45 with dot matrices of characters stored therein. The control circuit 40 further includes a dedicated I/F circuit 50 for providing an interface with external motors and the like, a head drive circuit 52 connected to the dedicated I/F circuit 50 for driving the print head unit 60 to eject ink, and a motor drive circuit 54 for driving the paper feed motor 22 and the carriage motor 24. The head drive circuit 52 includes a data reader 53.

The dedicated I/F circuit 50 includes a parallel interface circuit and can receive the print data PD sent from the computer via the connector 56. The printer 20 prints according to the print data PD. The RAM 44 functions as a buffer memory for temporarily storing the raster data.

Figure 6:
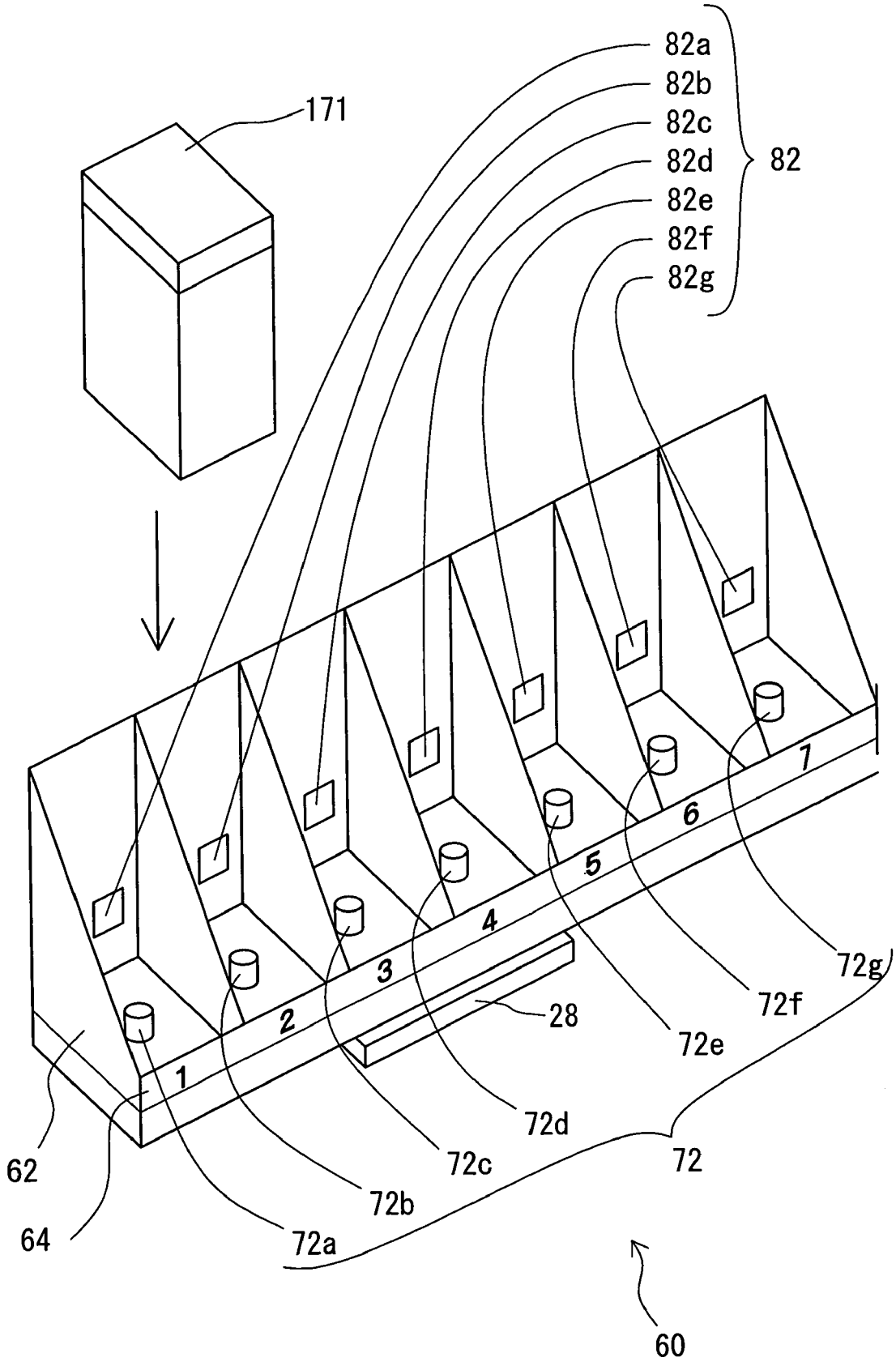
FIG. 6 is a perspective view of a print head unit.

FIG. 6 is a perspective view of the print head unit 60. The print head unit 60 includes the ink cartridge mount unit 62 and the print head 28. there can be mounted on the ink cartridge mount 62 a yellow in k cartridge 171Y containing yellow ink Y, a magenta ink cartridge 171M containing magenta ink M, a cyan ink cartridge 171C containing cyan ink C, a black ink cartridge 171 K containing black ink, a light cyan ink cartridge 171 LC containing light cyan ink that has substantially same hue as and lower density than the cyan ink C, a light magenta ink cartridge 171 LM containing light magenta ink that has substantially same hue as and lower density than the magenta ink M, and a dark yellow ink cartridge l71DY containing dark yellow ink DY that has substantially same hue as and higher density than the yellow ink Y, as also shown in FIG. 5.

These ink cartridges are respectively provided with memories 181Y, 181M, 181C, 181K, 181LC, 181LM, and 181DY for storing ink information (FIG. 5). These memories store the ink information for identifying the types of inks contained in the ink cartridges. These ink information are read out by the data reader 53 (FIG. 5) via seven memory readers 82*a*, 82*b*, 82*c*, 82*d*, 82*e*, 82*f*, and 82*g* included in the ink cartridge mount 62, and then sent as ink information signals to the computer 90 via the dedicated I/F circuit 50 and the connector 56. The seven memory readers and the data reader 53 function as a reader for the ink information. Furthermore, the ink cartridge mount 62 is provided with a label 64 for indicating mount positions of the ink cartridges.

The ink cartridge mount 62 is provided with seven conduits 72*a*, 72*b*, 72*c*, 72*d*, 72*e*, 72*f*, and 72*g* that are inserted into the respective ink cartridges to form flow paths for ink. These conduits are connected to the respective nozzle groups of the print head 28 provided on the bottom of the print head unit 60.

Figure 7:
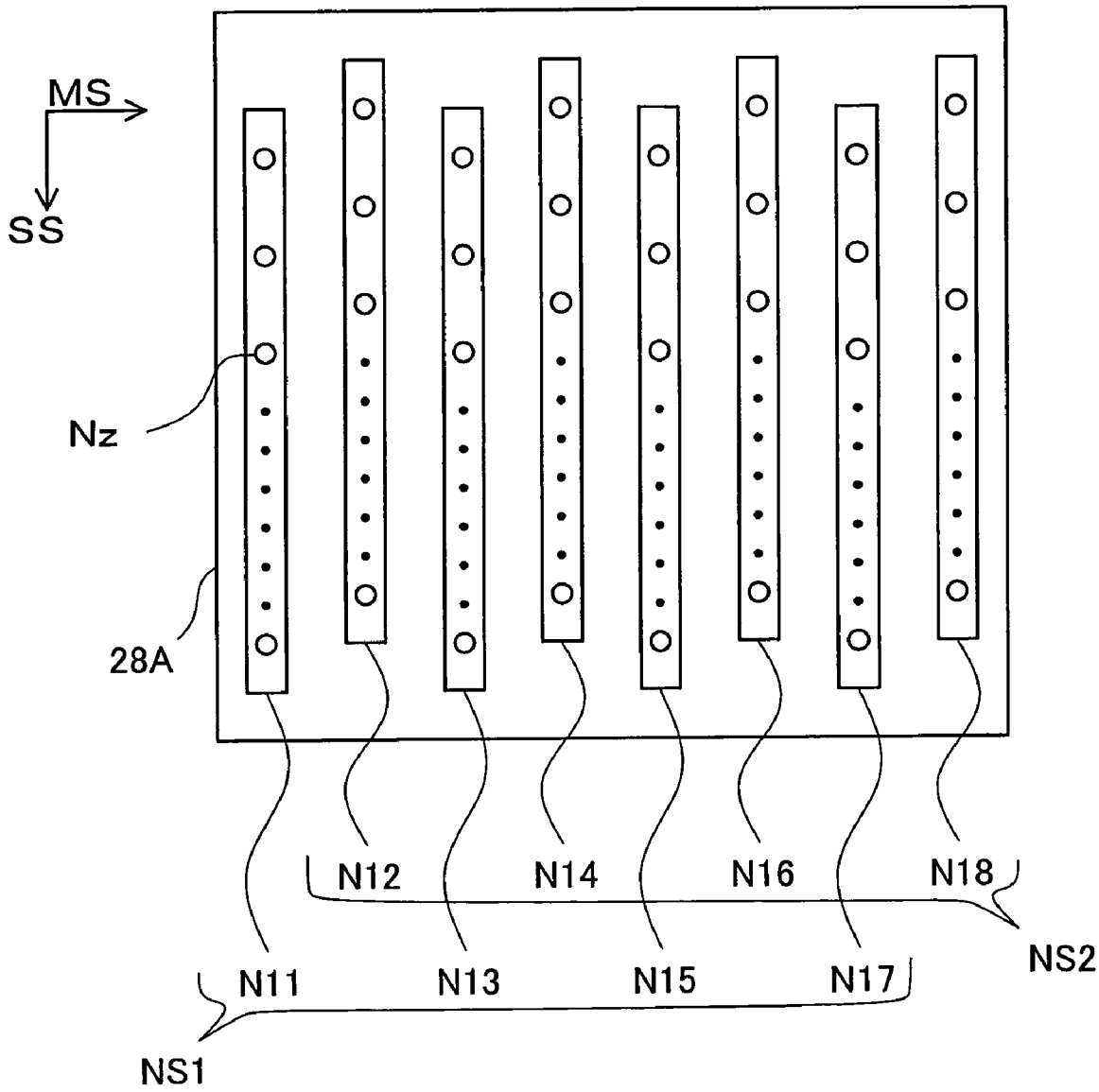
FIG. 7 is a schematic diagram that shows an arrangement of nozzles on an under surface of the print head.

FIG. 7 is a schematic diagram that shows an arrangement of nozzles on the bottom surface of the print head 28 according to this embodiment. The bottom surface of the print head 28 is provided with eight nozzle groups N11 through N18. A plurality of nozzles Nz constituting each of the nozzle groups are arranged along the sub scanning direction SS. In the example of FIG. 7, the plurality of nozzles Nz included in each of the nozzle groups are aligned along the sub scanning direction SS, but may be arranged in zigzag.

Among the eight nozzle groups N11 through N18, the four nozzle groups N11, N13, N15, and N17 (referred to as a first set of nozzle groups NS1) and another four nozzle groups N12, N14, N16, and N18 (referred to as a second set of nozzle groups NS2) are offset with each other in the sub scanning direction so that they does not overlap in the main scanning direction MS. Therefore, the first and second sets of nozzle groups can record mutually different raster lines (also referred to as main scanning lines) during a single main scan.

Each of the nozzle groups is supplied with ink from the ink cartridge mounted on the ink cartridge mount 62 to perform printing. Furthermore, replacing the ink cartridge according to need enables another type of ink to be used for printing. The types of ink supplied to each of the nozzle groups will be described later in detail.

In the printer 20 having the hardware structure described above, the paper feed motor 22 feeds the printing medium P, and the carriage motor 24 reciprocates the carriage 30 while the print head 28 is being driven for ejecting ink droplets of each color. The printer 20 accordingly forms ink dots and thus a multi-tone image on the printing medium P.

C. Outline of Adjustment Process of Dot Forming Positions

Figure 8A:
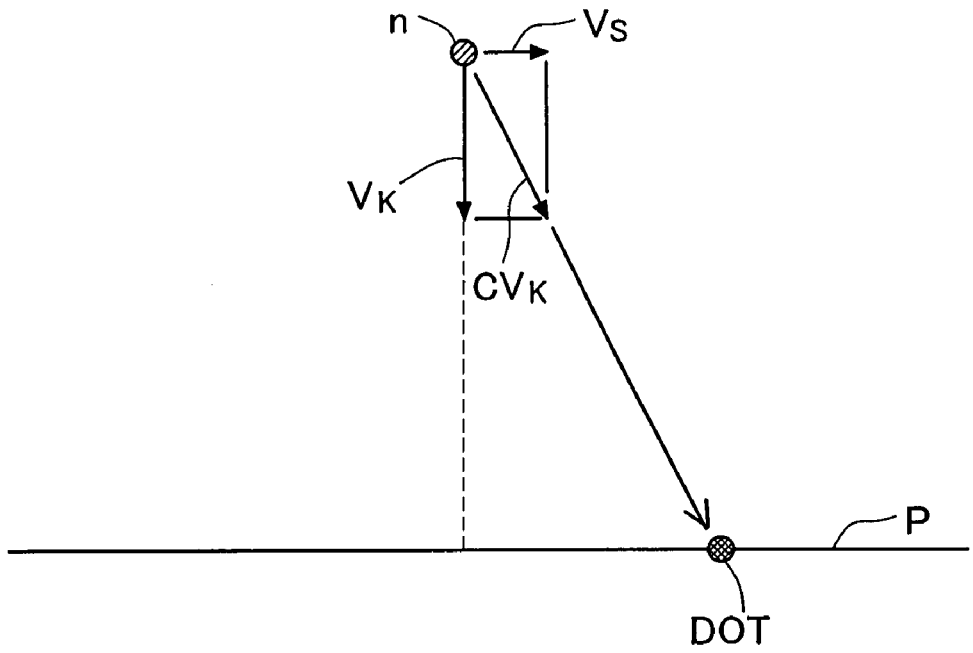
FIGS. 8(*a*) and 8(*b*) are schematic diagrams that show positional misalignments during bi-directional printing.
Figure 8B:
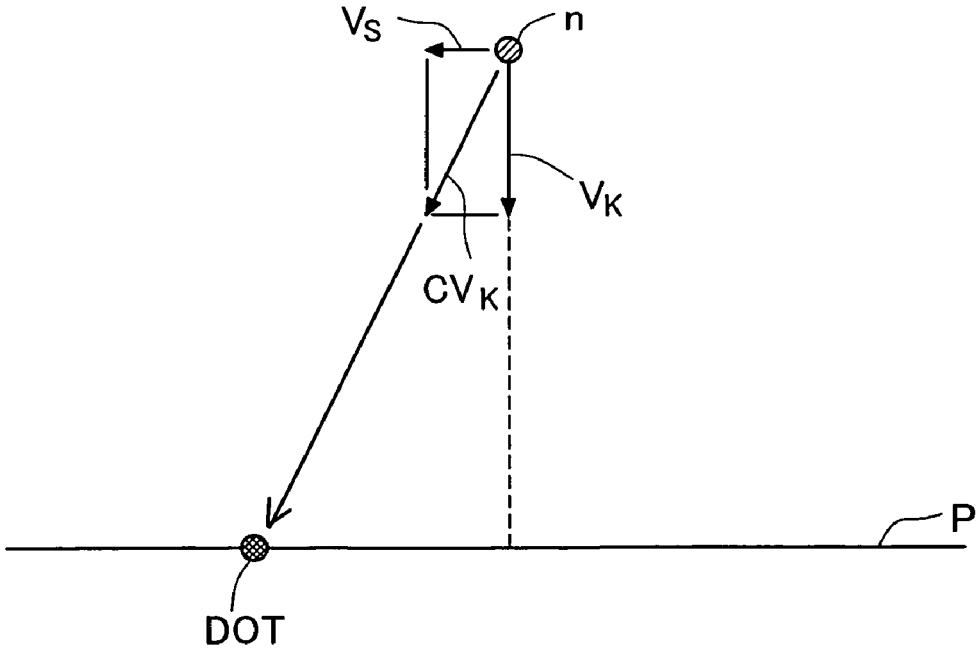

FIGS. 8(*a*) and 8(*b*) are schematic diagrams that show a positional misalignment during bi-directional printing. FIG. 8(*a*) shows an ink drop impingement position of a dot on a forward pass during printing while FIG. 8 (b) shows an ink drop impingement position of a dot on a backward pass during printing. A nozzle n moves horizontally and bi-directionally over the printing medium P and ejects ink on each of forward and backward passes to form dots on the printing medium P. It is assumed that the ink is ejected vertically downward at an ejection velocity Vk. The combined velocity vector CVk of each ink is obtained by combining the downward ejection velocity vector and the main scanning velocity vector Vs of the nozzle n. Therefore, the impingement positions of ink droplets onto the printing medium P are misaligned when the ink droplets are ejected while the printing medium P and the print head 28 (nozzle n) are at the same positional relationship on forward and backward passes of main scanning. Consequently, the ejection timing of ink droplets is adjusted on forward and backward passes of main scanning so that the impingement positions of ink droplets onto the printing medium are aligned.

In FIG. 8, the misalignments of dot forming positions are substantially symmetrical with respect to the position of the nozzle during the ejection of ink droplets on the forward and backward passes. There are, however, factors that prevent the misalignments on forward and backward passes from being symmetrical, such as the backlash of the drive mechanism for the main scanning direction and the warping of the platen that supports the printing medium from below. Also, in order to absorb the misalignments of dot forming positions caused by such factors, the ejection timing of ink droplets is preferably adjusted on forward and backward passes of main scanning.

C1. First Embodiment of Test Pattern

Figure 9:
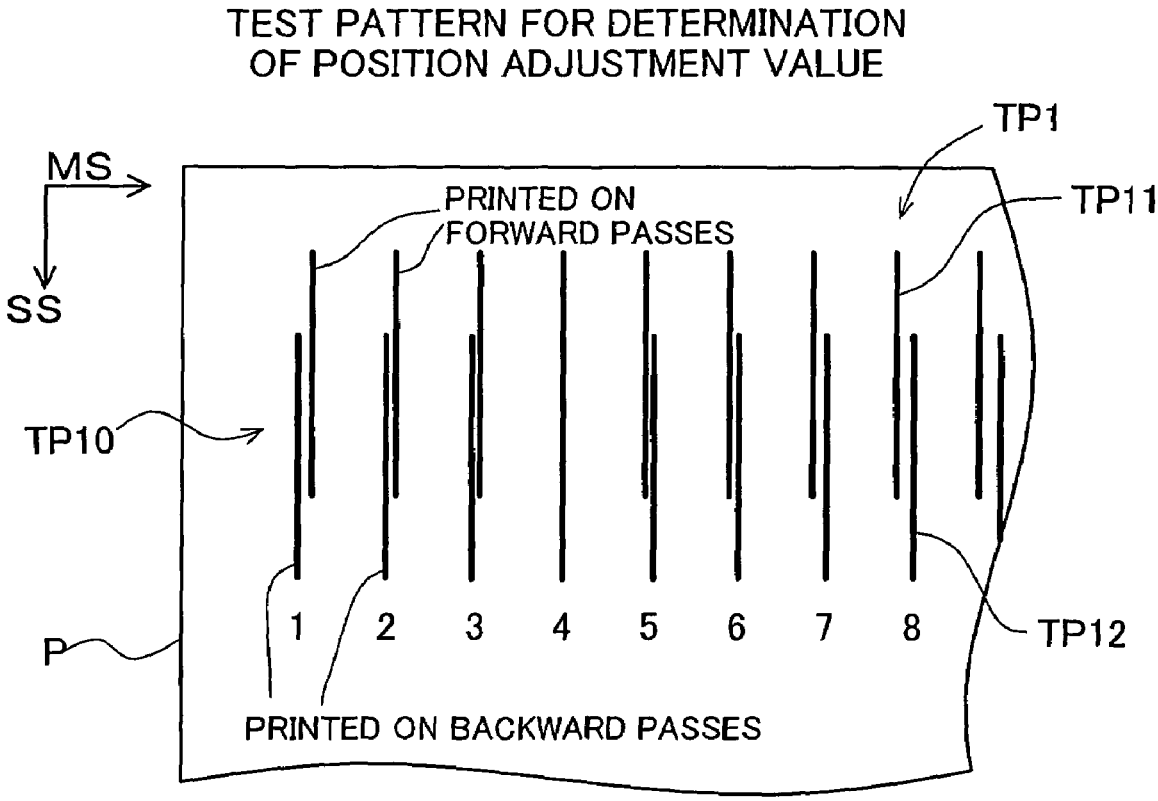
FIG. 9 is a schematic diagram that shows an exemplary test pattern.

FIG. 9 is a schematic diagram that shows an exemplary test pattern for testing misalignments of dot forming positions. This test pattern TP10 includes a plurality of vertical ruled lines printed on each of forward passes and backward passes of main scanning. Vertical ruled lines TP11 are recorded at regular intervals on forward passes while vertical ruled lines TP12 are recorded on backward passes so that positions of the vertical ruled lines TP12 are sequentially shifted by a predetermined value. As a result, a plurality of vertical ruled line pairs T1 are printed on the printing medium P such that the relative positions between the vertical ruled lines TP11 on forward passes and the vertical ruled lines TP12 on backward passes are sequentially shifted by the predetermined value (e.g. 1/1440 inch). The shift amount of each of the ruled line pairs corresponds to the position adjustment value. Numerals indicating position adjustment numbers are printed underneath the plurality of vertical ruled line pairs TP1. The position adjustment numbers are used to identify a preferred adjusted state. The term "preferred adjusted state" means a state in which the positions of dots formed on forward and backward passes are substantially aligned in the main scanning direction by adjusting the recording positions (or recording timing) on forward passes or backward passes with an appropriate position adjustment value. In the example of FIG. 9, the vertical ruled line pair with the position adjustment number 4 indicates the preferred adjusted state.

The user can set the position adjustment number indicating the preferred adjusted state and thus the position adjustment value for the bi-directional print mode by means of the position adjustment value setter 102 (FIGS. 1 and 3) of the computer 90. Details of the set position adjustment number will be described later. The test pattern of this embodiment is preferably used to set the position adjustment value when the bi-directional printing is performed with one type of ink.

C2. Second Embodiment of Test Pattern

Figure 10:
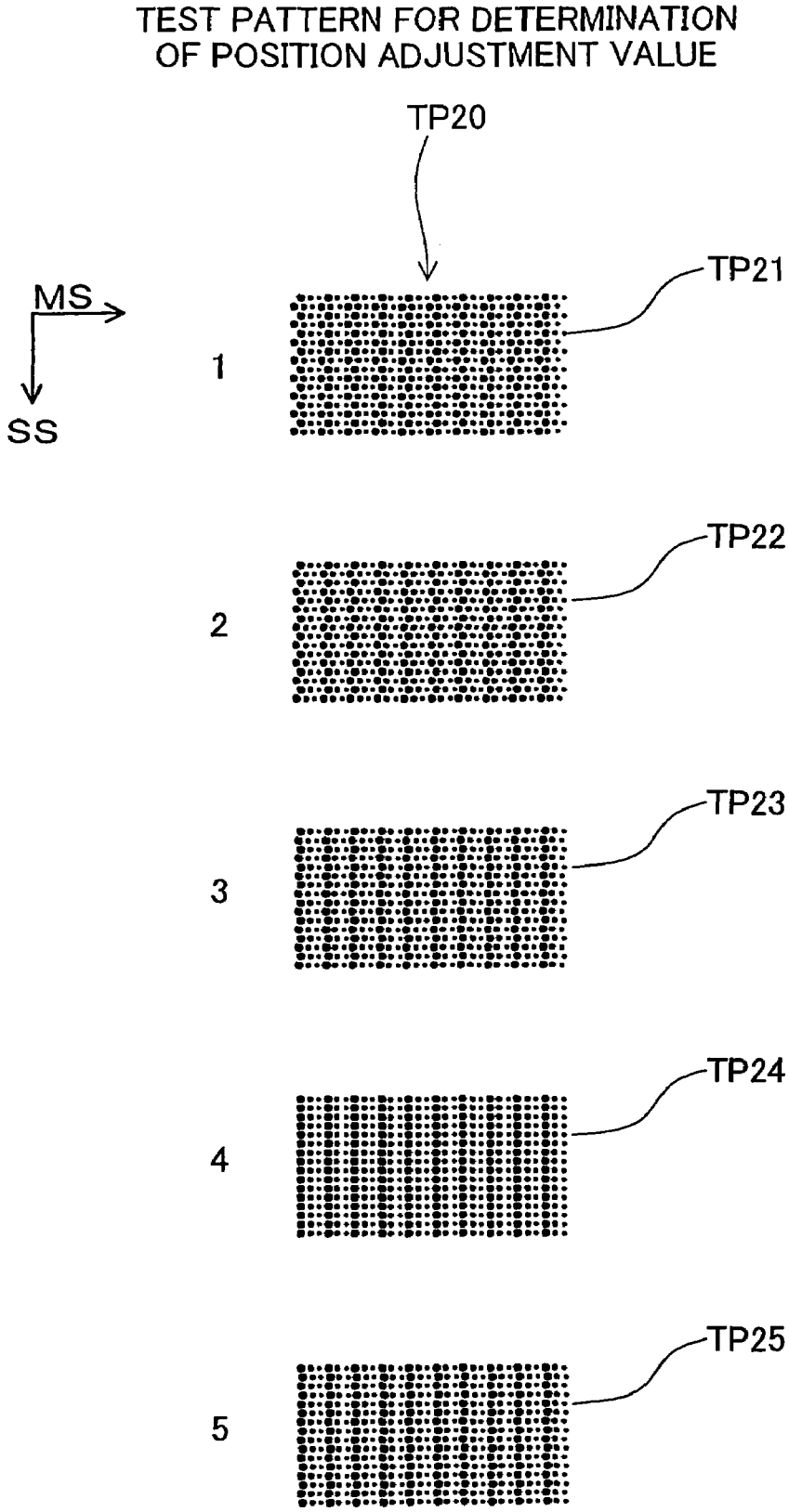
FIG. 10 is a schematic diagram that shows another exemplary test pattern.

FIG. 10 is a schematic diagram that shows another exemplary test pattern for testing misalignments of dot forming positions. This test pattern TP20 consists of a plurality of color patches TP21 through TP25 that are printed on both of forward and backward passes. The color patches are to reproduce an identical color. In the example of FIG. 10, each of the patches is illustrated as an aggregation of relatively large dots, but is actually made of dots with sizes that are not clearly visible.

The dots of each ink constituting each patch are recorded at the same position in the main scanning direction MS for each patch on forward passes while they are recorded at the positions subsequently shifted by a predetermined value (e.g. 1/2880 inch) in the main scanning direction MS for each patch on backward passes. The dots of each ink constituting each patch are shifted by a common shift value on backward passes. As a result, the plurality of color patches TP21 through TP25 are printed on the printing medium P such that the relative positions between the dots formed on forward passes and the dots formed on backward passes are sequentially shifted by the predetermined value. The shift amount of each of the color patches corresponds to the position adjustment value. Numerals indicating position adjustment numbers are printed on the left side of the color patches TP21 through TP25. The position adjustment numbers are used to identify a preferred adjusted state. The term "preferred adjusted state" represents a state in which the roughness of a color patch is minimized by adjusting the recording positions (or recording timing) on forward passes or backward passes with an appropriate position adjustment value. Therefore, the preferred adjusted state is achieved by the appropriate position adjustment value.

The example in FIG. 10 shows five color patches TP21 through TP25, which are provided with position adjustment numbers from 1 to 5 and are centered around a color patch TP23 labeled with the numeral "3." Among these color patches, the color patch TP24 with the position adjustment number 4 indicates the preferred adjusted state of minimal roughness. In the same way as in the first embodiment of test pattern described above, the user can set the position adjustment number indicating the preferred adjusted state and thus the position adjustment value for the bi-directional print mode by means of the position adjustment value setter 102 (FIGS. 1 and 3) of the computer 90. Details will be described later.

These color patches TP21 through TP25 are to reproduce mutually identical colors and are formed based on identical print data. The print data that form the basis for the color patches are obtained by a process in which color image data for expressing aggregated pixels of uniform density are converted to data for expressing the recording states of dots formed with a plurality of inks. This print data are generated by the test pattern generator 103 of the computer 90. Each of the color patches TP21 through TP25 is printed according to a sub scanning feed pattern that is performed during actual printing.

The color reproduced by the color patches may be selected based on the types of inks used and/or the type of image to be printed. For example, when three chromatic color inks of C, M, and Y are used for color printing, color patches that reproduce gray color consisting of these three chromatic color inks can be used to adjust the position adjustment value. This enables high-quality printing with reduced graininess (or roughness) throughout a color image to be performed when these three inks are used to print the color image. Alternatively, color patches reproducing a color in which graininess tends to be conspicuous, for example, skin color to which the user pays more attention may be used for the adjustment, thereby enabling high-quality printing with reduced graininess. The color reproduced by the color patches may be settable by the user.

The ink having particularly larger effect on picture quality due to its misalignments of dot forming positions may be used as the ink used to print the test pattern. For example, when ink dots have smaller size, the misalignments of their dot forming positions tend to be conspicuous since a color of the printing medium between the ink dots can be seen. When a plurality of inks that have substantially same hue and different densities are available, dots of lower density ink tend to have smaller size. In such case, using the ink with lower density to print the test pattern and then setting the position adjustment value enable high-quality printing with reduced graininess. For example, when the cyan ink C, the magenta ink M, the yellow ink Y, the light cyan ink LC, the light magenta ink LM, and the dark yellow ink DY are available, setting the position adjustment value based on the test pattern printed with the light cyan ink LC, the light magenta ink LM, and the yellow ink Y enables dot forming positions of these inks having larger effect on picture quality to be adjusted more properly. This enables high-quality printing with reduced graininess.

Figure 11:
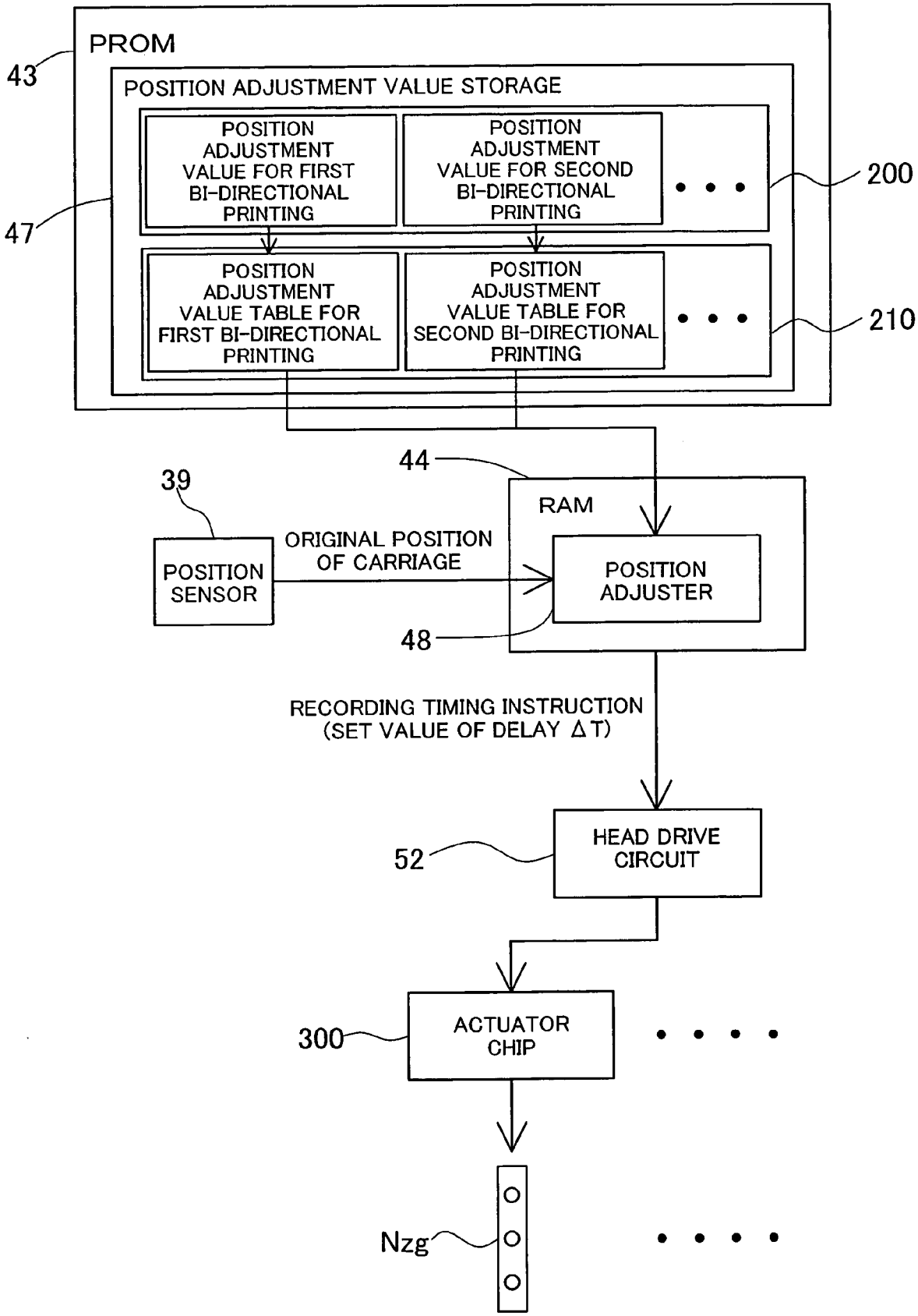
FIG. 11 is a block diagram that shows an outline of adjustment of misalignments of dot-forming positions.

C3. Adjustment of Misalignments of Dot Forming Positions Using Position Adjustment value FIG. 11 is a block diagram that shows an outline of adjustment of misalignments of dot forming positions during bi-directional printing. The PROM 43 included in the printer 20 is provided with a position adjustment number storage area 200 and a position adjustment value table 210. The position adjustment number storage area 200 and the position adjustment value table 210 function as the position adjustment value storage. A program that performs a process for adjusting dot forming positions is stored as the position adjuster in the RAM 44. Each of the nozzle groups Nzg included in the print head 28 is provided with an actuator chip 300 for causing the nozzles to eject ink, and operations of the actuator chips 300 are controlled by the head drive circuit 52.

The position adjustment number representing the preferred position adjustment value, which have been set by the user via the position adjustment value setter 102 (FIGS. 1 and 3) of the computer 90, are stored in the position adjustment number storage area 200. That is, "allowing the user to set the position adjustment value to be stored in the position adjustment value storage" includes allowing the user to set information (e.g. position adjustment number) for identifying the position adjustment value to be stored in the position adjustment storage. Furthermore, the position adjustment value setter 102 can store a plurality of position adjustment numbers for the plurality of bi-directional print modes including the first and second bi-directional print modes.

The position adjustment value table 210 stores relationships between amounts of misalignments of dot recording positions on backward passes (i.e. position adjustment values) and position adjustment numbers, and includes a plurality of tables that respectively correspond to the plurality of bi-directional print modes including the first and second bi-directional print modes.

The position adjustment unit 48 reads out the position adjustment value associated with the position adjustment number and associated with the used bi-directional print mode from the position adjustment value table 210, and then uses the position adjustment value to adjust dot recording positions on backward passes. More specifically, the position adjustment unit 48 receives information on the original position of the carriage 30 (FIG. 4) from the position sensor 39 and calculates the position of the carriage based on the information. The position adjustment unit 48 then controls the head drive circuit 52 so that the actuator chips 300 eject ink at an appropriate carriage position (or timing) based on the position adjustment value.

As described above, the adjustment of dot forming positions according to this embodiment is performed by selectively using the position adjustment value for the used bi-directional print mode out of the position adjustment values for a plurality of bi-directional print modes including the first and second bi-directional print modes that are made available by changing ink types. This ensures high-quality prints with reduced misalignments of dot forming positions even if the ink types are changed to perform another type of bi-directional printing with another combination of used inks.

Instead of the arrangement in which one actuator chip 300 is provided for each nozzle group, one actuator chip 300 may be provided for a plurality of nozzle groups. This enables the structure of the print head to be simplified. Furthermore, instead of the arrangement in which the single head drive circuit 52 controls all of the actuator chips 300, a plurality of head drive circuits 52 may be provided so that they share the controls of the actuator chips 300. This enables a different position adjustment value to be used for each head drive circuit 52 to adjust dot forming positions.

D. Embodiment of Adjustment Process of Dot Forming Positions

D1. First Embodiment of Adjustment Process of Dot Forming Positions

FIG. 12 is a schematic diagram that shows label numbers (FIG. 6) of the ink cartridges containing ink used by each of the nozzle groups, two available ink sets IS11 and IS12, and ink types included in each of the ink sets in this embodiment. Two nozzle groups N14 and N15 are supplied with ink from an identical ink cartridge (label number 4).

The first ink set IS11 includes four available inks (K, C, M, and Y). Each ink is ejected from two nozzle groups. As shown in FIG. 7, the two nozzle groups for ejecting each ink have mutually different positions of nozzles in the sub scanning direction. In other words, each of a first set of nozzle groups NS1 and a second set of nozzle groups NS2 that have mutually different positions of nozzles in the sub scanning direction can eject the four inks K, C, M, and Y Therefore, during a single main scan, using simultaneously the two nozzle groups for ejecting each of the inks enables mutually different raster lines to be recorded simultaneously. Thus, the use of the first ink set IS11 attains high-speed printing that uses simultaneously the two sets of nozzle groups NS1 and NS2 to achieve substantially higher print speed.

In the second ink set IS12, the three inks Y, M, and C of the label numbers 1 through 3 included in the first ink set IS11 have been replaced with the three inks DY, LM, and LC having different density, respectively. In order to replace the ink types, the ink cartridges are replaced. For example, when the yellow ink Y is replaced with the dark yellow ink DY, the yellow ink cartridge 171Y containing the yellow ink Y is replaced with the dark yellow ink cartridge 171DY containing the dark yellow ink DY The second ink set IS12 includes the seven available inks (DY, LM, LC, K, C, M, and Y). The inks are ejected from the nozzle groups N11 through N18, respectively; the black ink K is ejected from the two nozzle groups N14 and N15.

The light magenta ink LM has substantially same hue as and higher lightness (or lower density) than the magenta ink M. The light cyan ink LC has substantially same hue as and higher lightness than the cyan ink C. These light color inks can be used for relatively light areas to increase the number of ink dots. This enables to reduce graininess (or roughness of the image), which becomes more conspicuous as ink dots are decreased. Therefore, print quality can be improved in relatively light areas.

The dark yellow ink DY has substantially same hue as and lower lightness (or higher density) than the yellow ink Y. The dark yellow ink DY can be used for relatively dark areas to decrease the amount of ink applied thereto and reduce the number of ink dots. This enables to reduce breeding and banding (streak-like portion of low picture quality), which becomes more conspicuous as ink dots are increased. Therefore, print quality can be improved in relatively dark areas.

In this manner, the use of the second ink set IS12 attains high-quality printing, which uses a plurality of inks of different densities.

FIGS. 13(*a*) and 13(*b*) are schematic diagrams that show relationships between the two ink sets IS11 and IS12 and available bi-directional print modes. An upper row of each table shows combinations of nozzle groups and ink types while a lower row shows the available bi-directional print modes and combinations of inks (i.e. nozzle groups) used by the respective bi-directional print modes. Circled inks among the inks (i.e. nozzle groups) used by each of the bi-directional print modes are used to print the test pattern suitable for the bi-directional print mode.

When the first ink set IS11 is used, a monochrome bi-directional print mode using the black ink K and a four-color bi-directional print mode using the four inks (K, C, M, and Y) are available as shown in FIG. 13(*a*). The four-color print mode corresponds to the first bi-directional print mode.

In the monochrome bi-directional print mode, high-speed monochrome bi-directional printing can be performed, which uses the two nozzle groups N14 and N15 for ejecting the black ink K.

In the four-color bi-directional print mode, high-speed color bi-directional printing can be performed, which uses the pairs of nozzle groups for ejecting the respective inks among the four inks K, C, M, and Y during a single main scan.

When the second ink set IS12 is used, the monochrome bi-directional print mode using the black ink K and a seven-color bi-directional print mode using the seven inks (K, C, M, Y, LC, LM, and DY) are available as shown in FIG. 13(*b*). The seven-color print mode corresponds to the second bi-directional print mode.

The seven-color bi-directional print mode uses the light cyan ink LC, the light magenta ink LM, and the dark yellow ink DY as well as the four inks K, C, M, and Y used by the above-mentioned four-color bi-directional print mode, to thereby effect high-quality color bi-directional printing with improved graininess in relatively light areas and reduced breeding and banding in relatively dark areas.

Figure 14:
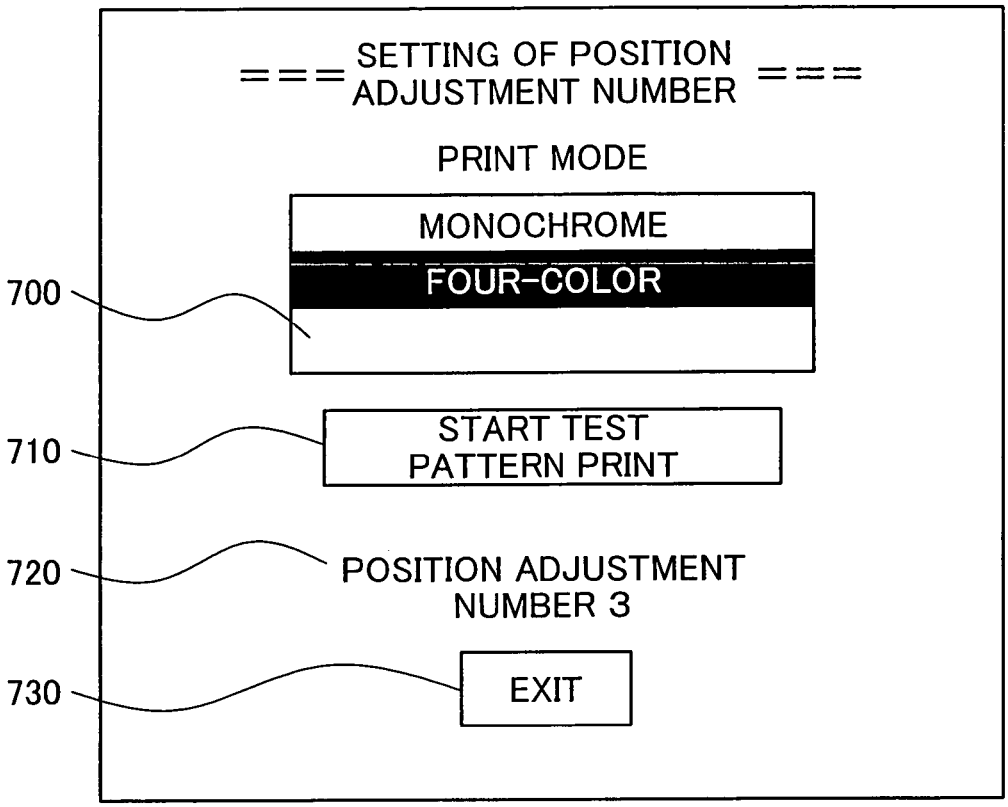
FIG. 14 is a schematic diagram that shows setting the position adjustment value (i.e. position adjustment number)

FIG. 14 is a schematic diagram that shows setting of the position adjustment value (i.e. position adjustment number) by means of the position adjustment vale setter 102 (FIG. 3) of the printer driver 96 in the flowchart of FIG. 2. FIG. 14 shows a case in which the seven ink cartridges (i.e. the first ink set IS11) for the four inks K, C, M, and Y are mounted. As shown in FIG. 14, when the user opens a position adjustment number setting window of the printer driver 96, the position adjustment value setter 102 displays the window for setting the position adjustment number on the CRT 21. The displayed window has a print mode display area 700, a test pattern print start button 710, a position adjustment number setting area 720, and a setting exit button 730.

The print mode display area 700 displays a list of bi-directional print modes that the mounted inks allow to be used. The position adjustment value setter 102 retains information on the combination of nozzle groups and ink types or information on the combination of ink cartridges and ink types that are required by each of the plurality of bi-directional print modes. The position adjustment value setter 102 can compare this information with information obtained from the above-mentioned ink information signals to determine whether or not each of the bi-directional print modes is available.

In the print mode display area 700, a selected bi-directional print mode is displayed in reversed colors, for example. In the example of FIG. 14, the four-color bi-directional print mode has been selected. The user can manipulate the print mode display area 700 to select a bi-directional print mode being subject to setting of the position adjustment number (step S10 shown in FIG. 2).

Next, the user manipulates the test pattern print start button 710 to print the test pattern suitable for the bi-directional print mode selected via the print mode display area 700 (step S20 shown in FIG. 2).

In the four-color bi-directional print mode, for example, the above-mentioned second embodiment of test pattern is used as the test pattern since color printing is performed with the plural types of inks. This test pattern is printed by means of the six nozzle groups N11, N12, N13, N16, N17, and N18 (FIG. 13(*a*)) for ejecting the three types of inks C, M, and Y. Gray color or skin color is available as the color of color patches included in the test pattern.

The user can use a printed result of this test pattern to determine a position adjustment number of a preferred adjusted state. The user inputs the preferred position adjustment number into the position adjustment number setting area 720 and then manipulates the setting exit button 730 to set the position adjustment number. The position adjustment number input into the position adjustment setting area 720 is stored as the position adjustment number for the four-color print mode in the position adjustment number storage area 200 (FIG. 11) of the position adjustment value storage 47 (step S30 shown in FIG. 2).

In the monochrome bi-directional print mode, for example, the above-mentioned first embodiment of test pattern is used as the test pattern since only the single ink type is used. This test pattern is printed by means of the two nozzle groups N14 and N15 (FIGS. 13(*a*) and (*b*)) for ejecting the black ink K.

In the seven-color bi-directional print mode, for example, the above-mentioned second embodiment of test pattern is used as the test pattern since color printing is performed with the plural types of inks. In addition, the inks (LC, LM, and Y) of lower densities among the chromatic color inks used for color printing are used to print the test pattern since this bi-directional print mode uses the plurality of inks that have substantially same hues and different densities.

Figure 15:
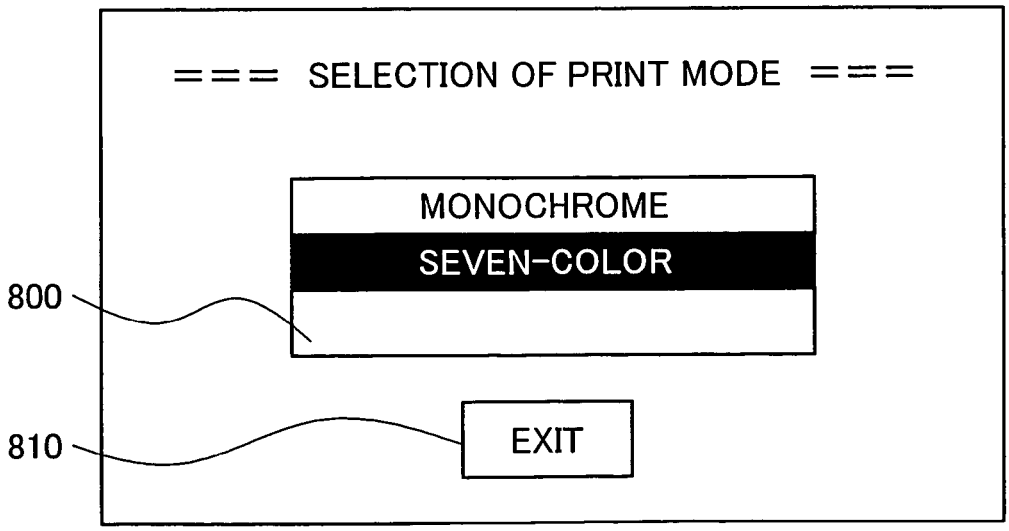
FIG. 15 is a schematic diagram that shows setting a bi-directional print mode used for printing.

FIG. 15 is a schematic diagram that shows setting of the bi-directional print mode used for printing by means of the print mode selector 101 (FIG. 3) of the printer driver 96. FIG. 15 shows a case in which the seven ink cartridges (i.e. the second ink set IS12) for the seven inks (L, C, M, Y, LC, LM, and DY) are mounted. As shown in FIG. 15, when the user opens a print mode selection window of the printer driver 96, the print mode selector 101 displays the window for selecting the print mode on the CRT 21. The displayed window has a print mode display area 800 and a setting exit button 810.

The print mode display area 800 displays a list of bi-directional print modes that the mounted inks allow to be used. The print mode selector 101 can use the information on ink types to select and then display available bi-directional modes in the same manner as the position adjustment value setter 102.

In the print mode display area 800, a selected bi-directional print mode is displayed in reversed colors, for example. In the example of FIG. 15, the seven-color bi-directional print mode has been selected. The user can manipulate the print mode display area 800 to select the bi-directional print mode used for printing.

Next, the setting exit button 810 is manipulated to complete the setting of bi-directional print mode used for printing. In order to perform printing, the position adjuster 48 (FIG. 11) refers to the position adjustment number for the selected bi-directional print mode, reads out the position adjustment value associated with the position adjustment number from the position adjustment value table 210, and then adjusts forming positions of ink dots based on the position adjustment value. In this manner, the position adjustment value for the current bi-directional print mode is used to adjust forming positions of ink dots, thereby effecting high-quality printing according to the bi-directional print mode even if another type of bi-directional print mode with another combination of available ink types is used.

However, when the position adjustment number for the used bi-directional print mode is not stored, that is, the position adjustment value for the used bi-directional print mode is not stored, a preset standard value may be used to adjust forming positions of ink dots. This enables printing even if the position adjustment number has not been set. The standard value can be stored in the position adjustment value storage 47 in advance. Alternatively, a position adjustment value for another bi-directional print mode may be used. The position adjustment value of another bi-directional print mode has different combination of ink types used, but is set by means of an identical apparatus. Therefore, this enables to reduce misalignments of dot forming positions due to the manufacturing error of the apparatus. For example, when the position adjustment number for the seven-color bi-directional print mode is not stored, the position adjustment value for the four-color bi-directional print mode may be used for the adjustment.

Figure 16:
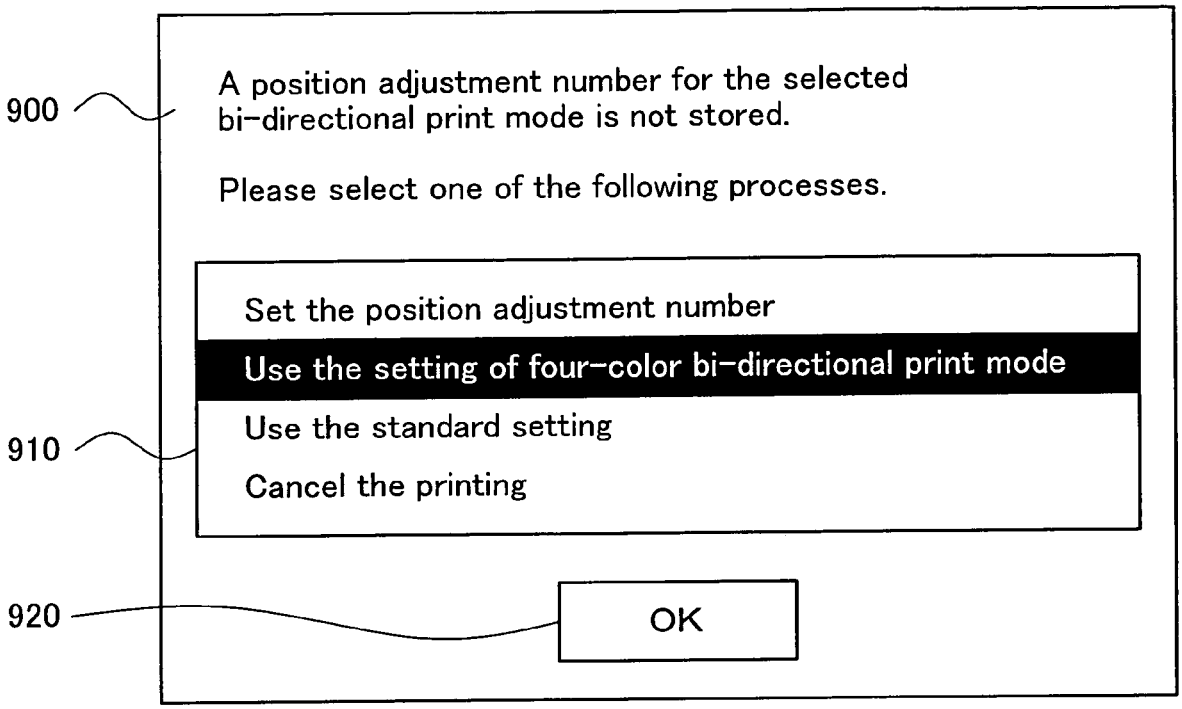
FIG. 16 is a schematic diagram that shows an exemplary warning.

FIG. 16 is a schematic diagram that shows an exemplary warning to be output when the position adjustment number for the used bi-directional print mode is not stored. When the position adjustment number storage area 200 (FIG. 11) of the printer 20 does not store the position adjustment number to be used, the position adjustment unit 48 displays a warning window shown in FIG. 16 on the CRT 21. The displayed window has a warning message 900 indicating that the position adjustment number is not stored, a process selection menu 910, and an acknowledge button 920.

The process selection menu 910 displays a list of processes that can be performed subsequently. The example of FIG. 16 includes the processes of 1) setting the position adjustment number for the used bi-directional print mode;
2) using the position adjustment value for another bi-directional print mode (which is the four-color print mode in example of FIG. 16) for the printing;
3) using the standard value for the printing; and
4) canceling the printing.

The user can manipulate the process selection menu 910 to select a desired process. In the example of FIG. 16, the selected process is displayed in reversed colors.

After the desired process is selected, the acknowledge button 920 is manipulated to perform the selected process. This arrangement enables the user to select a process according to the user's preference when the position adjustment number for the used bi-directional print mode is not stored.

In the three examples of FIGS. 14 through 16, all or part of the display may be shown on the control panel 32 of the printer 20 (FIG. 4).

D2. Second Embodiment of Adjustment Process of Dot Forming Positions

Figure 17:
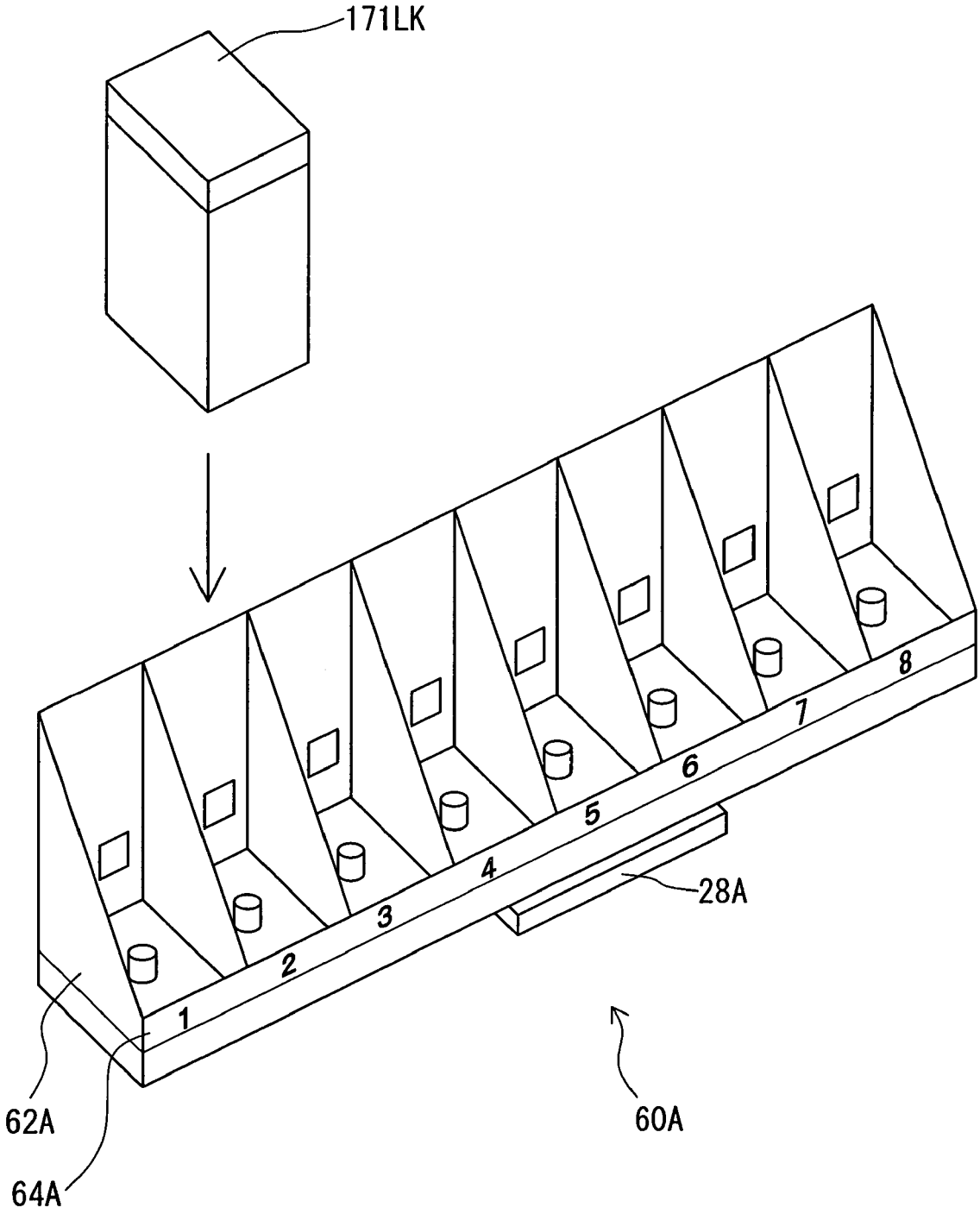
FIG. 17 is a perspective view of a print head unit.

The printer of this embodiment has almost the same structure as the above-mentioned first embodiment, but the structure of the print head unit differs from that of the first embodiment. FIG. 17 is a perspective view of the print head unit 60A according to this embodiment. There are two differences with the example of FIG. 6. A first difference is that it can mount eight ink cartridges thereon. A second difference is that it can mount a light black ink cartridge 171LK containing light black ink LK of lower density than the black ink K.

Figures 18A, 18B:
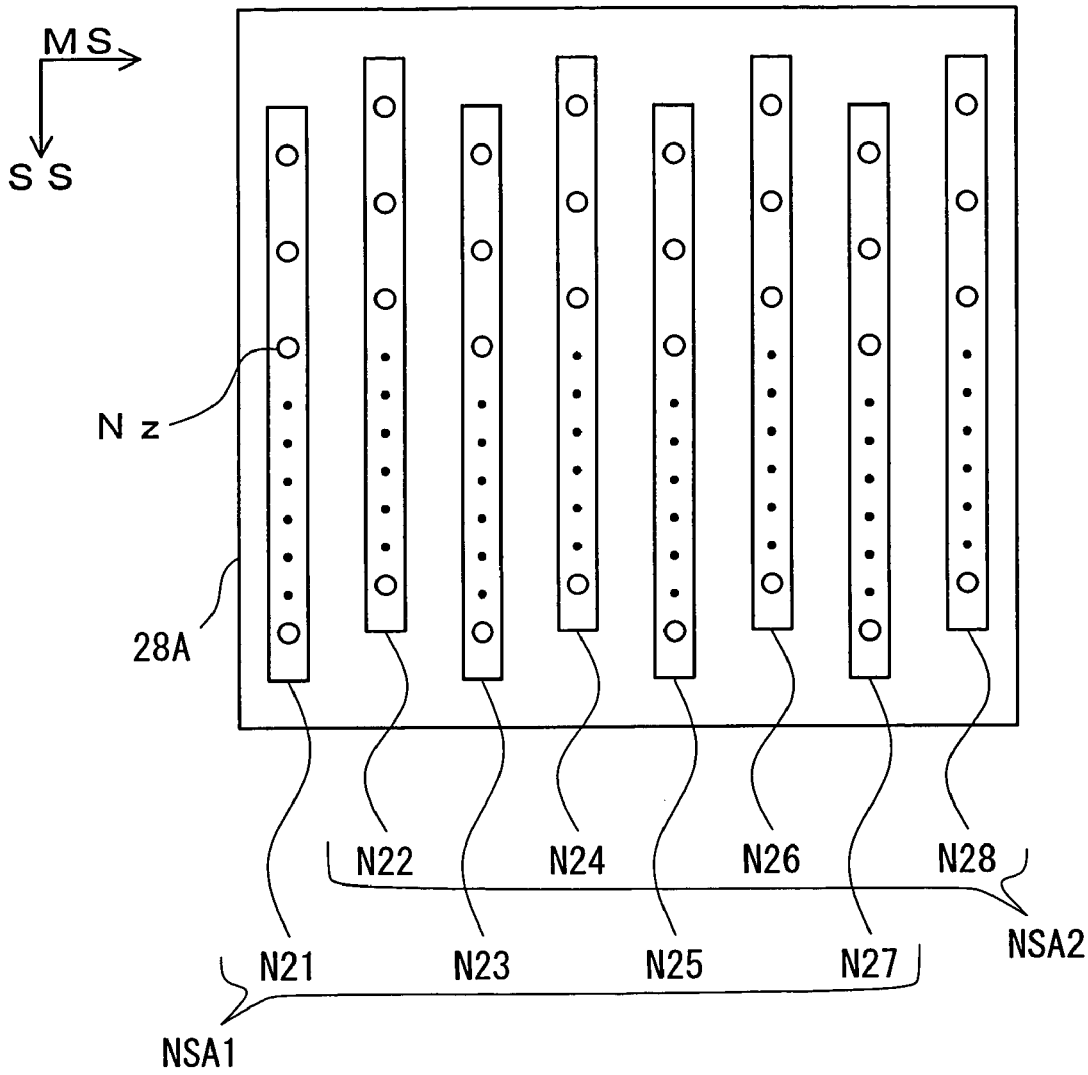
FIGS. 18(*a*) and 18(*b*) are schematic diagrams that show an arrangement of nozzles included in the print head and types of ink used by each of the nozzle groups.

FIGS. 18(*a*) and 18(*b*) are schematic diagrams that show an arrangement of nozzles of the print head and types of ink used by each of the nozzle groups according to this embodiment. FIG. 18(*a*) is a schematic diagram that shows the arrangement of the nozzles on the bottom surface of the print head 28A according to this embodiment. A difference with the example of FIG. 7 is that each of the eight nozzle groups is independently supplied with ink from one of the mutually different ink cartridges.

FIG. 18(*b*) is a schematic diagram that shows label numbers 64A (FIG. 17) of the ink cartridges containing ink used by each of the nozzle groups, two available ink sets IS21 and IS22, and types of inks included in each of the ink sets according to this embodiment. The type of ink ejected by each of the nozzle groups according to the first in set IS21 is identical to the type of ink ejected by each of the nozzle groups according to the first ink set IS11. According to the second ink set IS22, unlike the second ink set IS12 shown in FIG. 12, the fifth nozzle group N25 along the main scanning direction MS can eject the light black ink LK instead of the black ink K.

The light black ink LK has lower density than the black ink K. This light black ink LK can be used for relatively light areas to increase the number of ink dots. This may reduce graininess (roughness of the image), which becomes more conspicuous as ink dots are decreased. Therefore, the print quality can be improved in relatively light areas.

FIGS. 19(*a*) and 19(*b*) are schematic diagrams that show relationships between the two ink sets IS21 and IS22 and the available bi-directional print modes. The difference with the example of FIGS. 13(*a*) and 13(*b*) is that a high-quality monochrome bi-directional print mode and an eight-color bi-directional print mode are available instead of the seven-color bi-directional print mode. In this example, the four-color bi-directional print mode corresponds to the first bi-directional print mode while the eight-color bi-directional print mode corresponds to the second bi-directional print mode.

In the high-quality monochrome print mode, the black ink K and the light black ink LK can be used to achieve high-quality monochrome bi-directional printing with reduced graininess in relatively light areas. This print mode is used to print a photo image and the like in monochrome.

In the high-quality monochrome bi-directional print mode, for example, the above-mentioned second embodiment of test pattern is used as the test pattern since monochrome printing is performed with the plural types of inks. The light black ink LK of lower density is used to print the test pattern since this bi-directional print mode uses the plurality of inks that have different densities. The test pattern consists of gray color patches, which are made of ink dots formed by the nozzle group N25 for ejecting the light black ink LK. The user can select a state with minimal roughness among the plurality of color patches having different position adjustment values to select an appropriate position adjustment number.

The eight-color bi-directional print mode uses the light cyan ink LC, the light magenta ink LM, the dark yellow ink DY, and the light black ink LK as well as the four inks K, C, M, and Y used by the four-color bi-directional print mode, to thereby effect high-quality color bi-directional printing with improved graininess in relatively light areas and reduced breeding and banding in relatively dark areas.

In the eight-color bi-directional print mode, for example, the above-mentioned second embodiment of test pattern is used as the test pattern since color printing is performed with the plural types of inks. In addition, the inks (LC, LM, Y, and LK) of lower densities among the inks used for printing are used to print the test pattern since this bi-directional print mode uses the plurality of inks that have substantially same hues and different densities. The position adjustment value (i.e. position adjustment number) is set based on a printed result of this test pattern, thereby ensuring seven-color bi-directional printing with reduced roughness, graininess, bleeding and banding. Gray color and skin color are available as the color of the color patches included in the test pattern.

The monochrome bi-directional print mode according to the first ink set IS21 and the monochrome bidirectional print mode according to the second ink set IS22 differ in numbers of used nozzle groups. Therefore, in setting the position adjustment numbers, independent test patterns are used to set independent position adjustment numbers. In this manner, when the used ink types are identical but the numbers and/or the arrangements of the used nozzle groups are different, mutually different position adjustment numbers are used to adjust dot forming positions, thereby attaining higher-quality printed result.

In the embodiments described above, the position adjustment value for the used bi-directional print mode is selectively used to adjust ink dot forming positions. This attains high-quality prints with reduced misalignments of dot forming positions even if the ink types are replaced to perform another type of bi-directional printing with another combination of used inks.

E. Modifications

The present invention is not restricted to the above examples or embodiments, but there may be many other aspects without departing from the scope or spirit of the present invention. For example, the following modifications are applicable.

E1. Modification 1

Although the print head unit 60 is configured to mount an independent ink cartridge for each ink in the above-mentioned various embodiments, it may be configured to mount an ink cartridge having a plurality of ink tanks. For example, all of the ink tanks may be included in a single cartridge so that one of such ink cartridges is mounted according to the requirements to perform printing. This facilitates installation of an ink cartridge suitable for the desired bi-directional print mode. In general, the present invention may use any ink cartridge mount as long as a plurality of ink tanks respectively containing a plurality of inks can be installed on the ink cartridge mount.

As also understood from the above description, the term "ink tank" here means a container for containing one type of ink. In addition, the term "ink cartridge" means a container that is made in an integrated fashion and has at least one ink tank.

E2. Modification 2

The ink information stored in the memory of the ink cartridge may include an expiration date of ink and/or information for specifying a remaining quantity of ink. This enables a replacement of ink to be advised when the expiration date of the required ink has passed or when the remaining quantity of the required ink is almost equal to 0.

Furthermore, information usable for setting position adjustment values may be stored in the memory of the ink cartridge so that the position adjustment values during bi-directional printing are set based on such information. For example, a plurality of position adjustment values for a plurality of bi-directional print modes may be stored in the memory of the ink cartridge so that these position adjustment values are transferred to and then stored in the memory (or position adjustment value storage) of the main body of the printing apparatus. Alternatively, correction values for correcting the standard position adjustment value stored in the memory (or position adjustment value storage) of the main body of the printing apparatus may be stored in the memory of the ink cartridge.

E3. Modification 3

The memory reader in the ink cartridge mount 62 may be applicable to only ink cartridges to be subject to replacement. In the above-mentioned embodiment, when only the three ink cartridges mounted at the positions represented by the numbers 1, 2, and 3 of the label 64 (FIG. 6) are replaceable, only the three memory readers 82*a*, 82*b*, and 82*c* may be constructed in the ink cartridge mount 62 to enable selection of an appropriate bi-directional print mode. The memory and the memory reader may communicate in a contact or non-contact manner to read out the information.

E4. Modification 4

The number of nozzle groups included in the print head 28 is not limited to eight, but may be set appropriately according to ink types included in available ink sets. For example, another nozzle group for adding an available ink may be provided to make red ink available so that high-quality bi-directional printing can be performed, which more finely adjusts color tones in red areas. Furthermore, the types of available inks are not limited to seven colors or eight colors. In any case, when the ink types are replaced to use another type of bi-directional print mode with another combination of ink types used, the position adjustment value for the used bi-directional print mode is used to adjust dot forming positions.

E5. Modification 5

The present invention is also applicable to drum type printers. Such printing apparatus includes, for example, a facsimile and a copy machine. In the drum printer, a drum rotating direction corresponds to the main scanning direction while a carriage moving direction corresponds to the sub scanning direction. The present invention is not limited to ink jet printers, but is generally applicable to any dot recording apparatus that uses a recording head having a plurality of nozzle groups to record dots on a surface of printing medium.

E6. Modification 6

In the above-mentioned embodiments, a part of the structure realized in the form of hardware may be replaced with software, and on the contrary, a part of the structure realized in the form of software may be replaced with hardware. For example, a part or all of the functions of the printer driver 96 shown in FIG. 3 may be performed by the control circuit 40 of the printer 20. In such case, a part or all of the functions of the computer 90 as a print controller for generating print data is realized by the control circuit 40 of the printer 20.

E7. Modification 7

When a part or all of the functions of the present invention are implemented by software, the software (or computer program) may be stored in a computer-readable recording medium. In the present invention, the "computer-readable medium" is not limited to portable recording media such as flexible disk and CD-ROM, but may also include a variety of internal storage devices included in the computer such as RAM, ROM and external storage devices attached to the computer such as hard disk.

E8. Modification 8

Although the print head and the ink cartridge mount are made in an integrated fashion in the above-mentioned embodiments, the print head may be connected with the ink cartridge mount via ink supply channels so that the print head can move independently of the ink cartridge mount. This enables the ink cartridge mount to be located at any position independently of the print head. For example, a portion on which the ink cartridge is mounted may appear outside of the printing apparatus, thereby facilitating installation of the ink cartridge. The ink supply channels may be made from tubes of elastic body such as rubber and silicon and have sufficient length so that the print head is free to move within its moving range.

Although the present invention has been described and illustrated in detail, these descriptions and illustrations are illustrative and not restrictive, but the spirit and scope of the present invention are limited only by the appended claims.

What is claimed is:

1. A printing apparatus comprising a print head that has a plurality of nozzle groups each including a plurality of nozzles for ejecting an identical color, the printing apparatus having a bi-directional printing function of performing main scanning for moving the print head relative to a printing medium and sub scanning for moving the print head relative to the printing medium in a direction that transverses a direction of the main scanning, and ejecting ink from nozzles onto the printing medium on each of forward passes and backward passes of the main scanning of bi-directional movement to form dots on the printing medium, the printing apparatus comprising:

a position adjustment value storage that stores a position adjustment value for reducing misalignments of dot forming positions between forward passes and backward passes of the main scanning;

a position adjuster that adjusts dot forming positions along the main scanning direction during the bi-directional printing based on the position adjustment value stored in the position adjustment storage;

a print head fixed to the printing apparatus, comprising an ink cartridge mount that is configured to mount one or more ink cartridges thereon, wherein each of the one or more ink cartridges comprises:

an ink set including a combination of at least two ink tanks, each containing ink to be supplied to each of the nozzle groups, wherein each ink set includes at least one separable ink tank which is separable from the print head, such that in a first ink set of the printing apparatus, at least the separable ink tank is replaceable with another ink tank containing a different type of ink, thereby changing combination of ink tanks therein to form a second ink set, without replacing the print head;

the printing apparatus is configured to use a first bi-directional print mode that selectively uses inks included in the first ink set and a second bi-directional print mode that selectively used inks included in the second ink set so that a combination of inks used in the first bi-directional print mode is different from a combination of inks used in the second bi-directional print mode, the position adjustment value storage is configured to store a plurality of position adjustment values including a first position adjustment value for the first bi-directional print mode and a second position adjustment value for the second bi-directional print mode, and the position adjuster selects a position adjustment value for a bi-directional print mode used by the printing apparatus out of the plurality of position adjustment values to adjust dot forming positions;

wherein each of the one or more ink cartridges further comprises a memory which stores information including types of ink contained therein, wherein the printing apparatus further comprises:

a reader, which reads out information stored in the memory of the one or more ink cartridges, and a print mode selector which specifies an ink set available to the printing apparatus according to the information read out by the reader, and which selects a bi-directional print mode according to the specified ink set; and wherein the position adjuster selects the position adjustment value according to the selected bi-directional print mode.

2. A printing apparatus according to claim 1, wherein the first bi-directional print mode and the second bi-directional print mode are bi-directional color printing modes.

3. A printing apparatus according to claim 1, further comprising:

a test pattern generator that generates a test pattern to be printed, wherein the test pattern can be used to test misalignments of the dot forming positions; and a position adjustment value setter that allows a user to set the position adjustment value to be stored in the position adjustment value storage, wherein the test pattern generator can generate a test pattern suitable for the first bi-directional print mode and a test pattern suitable for the second bi-directional print mode.

4. A printing apparatus according to claim 3, wherein the position adjustment value setter displays a plurality of bi-directional print modes available to the printing apparatus based on information read out by the reader and the print mode selector selects the bi-directional print mode based on a user selection out of the plurality of available bi-directional print modes; and the test pattern generator generates the test pattern suitable for the bi-directional print mode selected via the position adjustment value setter.

5. A printing apparatus according to claim 1, wherein the position adjuster uses a preset standard value when the position adjustment value storage does not store the position adjustment value for the bi-directional print mode used by the printing apparatus.

6. A printing apparatus according to claim 1, wherein the position adjuster uses the position adjustment value for another bi-directional print mode when the position adjustment value storage does not store the position adjustment value for the bi-directional print mode used by the printing apparatus.

7. A printing apparatus according to claim 1, wherein the position adjuster outputs a warning when the position adjustment value storage does not store the position adjustment value for the bi-directional print mode used by the printing apparatus.

8. A bi-directional printing method using a printing apparatus, the printing method comprising the steps of:

(a) providing a print head which is fixed to the printing apparatus, comprising a plurality of nozzles;

(b) selectably mounting, on the print head, a first ink set or a second ink set, having mutually different combinations of ink, wherein the first ink set and the second ink set are associated with a first hi-directional print mode and a second hi-directional print mode, respectively;

(c) providing a plurality of position adjustment values including a first position adjustment value for the first hi-directional print mode and a second position adjustment value for the second bi-directional print mode as position adjustment values for reducing misalignments of dot forming positions on forward passes and backward passes of main scanning;

(d) selecting one of the first bi-directional print mode that selectively uses inks included in the first ink set and the second bi-directional print mode which selectively uses inks included in the second ink set, so that a combination of inks used in the first bi-directional print mode is different from a combination of inks used in the second bi-directional print mode;

(e) selecting a position adjustment value for the selected bi-directional print mode out of the plurality of position adjustment values; and (f) adjusting dot forming positions along the main scanning direction during the bi-directional printing based on the selected position adjustment value;

wherein selectably mounting the first ink set or the second ink set comprises replacing at least a first ink tank of the first ink set with a second ink tank of the second ink set, thereby changing from the first ink set to the second ink set without replacing the print head; wherein the second ink tank of the second ink set contains ink having the same hue but different density as ink of the first ink tank of the first ink set.

9. A method according to claim 8, wherein the first bi-directional print mode and the second bi-directional print mode are bi-directional color printing modes.

10. A method according to claim 8, further comprising the steps of:

(g) generating a test pattern to be printed, wherein the test pattern can be used to test misalignments of the dot forming positions; and (h) allowing a user to set a position adjustment value that is to be stored in a position adjustment value storage according to a printed result of the test pattern, wherein the test pattern generated in step (g) is a test pattern suitable for one of the first bi-directional print mode and the second bi-directional print mode.

11. A method according to claim 10, wherein each ink tank of the first ink set and the second ink set is contained in an ink cartridge, wherein each ink cartridge comprises at least one ink tank and a memory that stores information including types of contained inks, and generating the test pattern of the step (g) comprises:

(g1) displaying a plurality of bi-directional print modes available to the printing apparatus based on the information read out from the memory and allowing a user to select a bi-directional print mode that is to be subject to setting of the position adjustment value out of the plurality of available bi-directional print modes; and (g2) generating the test pattern suitable for the selected bi-directional print mode.

12. A method according to claim 8, wherein each ink tank of the first ink set and the second ink set is contained in an ink cartridge, wherein each ink cartridge comprises at least one ink tank and a memory that stores information used to set the position adjustment value, and the method further comprises:

(c') setting the position adjustment value based on the information read out from the memory.

13. A method according to claim 8, wherein the step (e) includes:

using a preset standard value when the position adjustment value for a third bi-directional print mode to be used by the printing apparatus is not prepared in advance.

14. A method according to claim 8, wherein the step (e) includes:

using the position adjustment value for another bi-directional print mode when the position adjustment value for a third bi-directional print mode to be used by the printing apparatus is not prepared in advance.

15. A method according to claim 8, wherein the step (e) includes:

outputting a warning when the position adjustment value for a third bi-directional print mode to be used by the printing apparatus is not prepared in advance.

16. A bi-directional printing method comprising:

providing a printing apparatus having a print head fixed to the printing apparatus, capable of selectably mounting thereon a first ink set or a second ink set associated with a first bi-directional print mode and a second bi-directional print mode, respectively;

storing a first plurality of position adjustment values associated with the first bi-directional print mode and a second plurality of position adjustment values associated with the second bi-directional print mode;

selecting a first position adjustment value or a second position adjustment value; and adjusting dot forming positions along a main scanning direction during bi-directional printing based on the selected first position adjustment value or second position adjustment value;

wherein at least a first ink tank of the first ink set is replaceable with a second ink tank of the second ink set, thereby changing from the first ink set to the second ink set without replacing the print head, wherein the second ink tank of the second ink set contains ink having the same hue but different density as ink of the first ink tank of the first ink set.

17. The method according to claim 16, wherein the first bi-directional print mode and the second bi-directional print mode are bi-directional color printing modes.

18. The method according to claim 16 wherein selecting the first position adjustment value or the second position adjustment value comprises:

printing a test pattern using the first plurality of position adjustment values or the second plurality of position adjustment values;

selecting the first position adjustment value or the second position adjustment value according to the printed test pattern.

19. The method according to claim 16, wherein the first ink set is contained in a first ink cartridge and the second ink set is contained in a second ink cartridge and the first and second ink cartridges each comprise a memory in which is stored information including the types of inks included in the ink cartridge; and wherein selecting the first position adjustment value or the second position adjustment value comprises:

displaying a plurality of available bi-directional print modes based on information read out of the memory of the first ink cartridge or the second ink cartridge;

selecting a bi-directional print mode from among the displayed bi-directional print modes;

printing a test pattern using the plurality of position adjustment values for the selected bi-directional print mode; and selecting the position adjustment value according to the printed test pattern.

20. The method according to claim 16, wherein wherein the first ink set is contained in a first ink cartridge and the second ink set is contained in a second ink cartridge and the first and second ink cartridges each comprise a memory in which is stored information including the types of inks included in the ink cartridge; and wherein the first position adjustment value or the second position adjustment value is selected according to information stored in the memory of the first ink cartridge or the second ink cartridge.

21. The method according to claim 16, wherein selecting the first position adjustment value or the second position adjustment value comprises selecting a preset standard value.

22. The method according to claim 16, wherein selecting the first position adjustment value or the second position adjustment value comprises:

selecting the second position adjustment value when no first position adjustment value is stored; and selecting the first position adjustment value when no second position adjustment value is stored.

23. The method according to claim 16, further comprising:

outputting a warning when no first position adjustment value is stored; and outputting a warning when no second position adjustment value is stored.

* * * * *